US006732542B2

(12) United States Patent
Yamasaki et al.

(10) Patent No.: US 6,732,542 B2
(45) Date of Patent: May 11, 2004

(54) DEFROSTER OF REFRIGERANT CIRCUIT AND ROTARY COMPRESSOR

(75) Inventors: Haruhisa Yamasaki, Gunma (JP); Masaya Tadano, Gunma (JP); Kenzo Matsumoto, Gunma (JP); Kazuya Sato, Gunma (JP); Dai Matsuura, Gunma (JP); Takayasu Saito, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 21 days.

(21) Appl. No.: 10/288,586

(22) Filed: Nov. 6, 2002

(65) Prior Publication Data

US 2003/0106330 A1 Jun. 12, 2003

(30) Foreign Application Priority Data

Nov. 19, 2001 (JP) ..... 2001-353548
Nov. 26, 2001 (JP) ..... 2001-359131

(51) Int. Cl.[7] ..... F01C 1/30; F25B 1/10
(52) U.S. Cl. ..... 62/278; 62/510; 418/11; 418/249
(58) Field of Search ..... 418/11, 249; 62/510, 62/196.2, 278

(56) References Cited

U.S. PATENT DOCUMENTS 6,318,981 B1 * 11/2001 Ebara et al. ..... 418/11
6,651,458 B1 * 11/2003 Ebara et al.

* cited by examiner

*Primary Examiner*—William Wayner
(74) *Attorney, Agent, or Firm*—Armstrong, Kratz, Quintos, Hanson & Brooks, LLP.

(57) ABSTRACT

A defroster restrains a vane jump that takes place when an evaporator is defrosted in a refrigerant circuit using a so-called internal intermediate-pressure type double-stage compression rotary compressor. The defroster includes a rotary compressor that discharges a refrigerant gas that has been compressed by a first rotary compressing unit into a hermetic vessel and further compresses the discharged intermediate-pressure refrigerant gas, a gas cooler, an expansion valve, and an evaporator. To defrost the evaporator, the refrigerant gas discharged from the second rotary compressing unit is introduced into the evaporator without decompressing it by the expansion valve. Furthermore, the refrigerant gas discharged from the first rotary compressing unit is introduced into the evaporator. At the same time, an electromotive unit of the rotary compressor is run at a predetermined number of revolutions. The inertial force of a vane at the foregoing number of revolutions is set to be smaller than the urging force of a spring.

12 Claims, 18 Drawing Sheets

DEFROSTER OF REFRIGERANT CIRCUIT AND ROTARY COMPRESSOR

BACKGROUND OF THE INVENTION

1. Field of the Invention

The present invention relates to a defroster of a refrigerant circuit that uses a so-called internal intermediate pressure type two-stage compression rotary compressor, and a rotary compressor used in the refrigerant circuit.

2. Description of the Related Art

In a conventional refrigerant circuit of the aforesaid type, especially in the case of a refrigerant circuit using an internal intermediate pressure type two-stage compression rotary compressor, a refrigerant gas is introduced into a low-pressure chamber of a cylinder through a suction port of a first rotary compressing unit of the rotary compressor, and compressed into an intermediate pressure by a roller and a vane, then discharged from a high-pressure chamber of a cylinder into a hermetic vessel through the intermediary of a discharge port and a discharge muffling chamber. Further, the refrigerant gas of the intermediate pressure in the hermetic vessel is introduced into the low-pressure chamber of the cylinder through the suction port of a second rotary compressing unit, subjected to the second-stage compression by the roller and the vane to become a hot, high-pressure refrigerant gas, and introduced from the high-pressure chamber into a radiator of a gas cooler or the like constituting a refrigerant circuit through the intermediary of the discharge port and the discharge muffling chamber. In the radiator, the hot, high-pressure refrigerant gas radiates heat to effect heating action, and it is throttled by an expansion valve or a decompressor before it enters an evaporator where it absorbs heat to evaporate. After that, the cycle that begins with the suction into the first rotary compressing unit is repeated.

If a refrigerant exhibiting a large difference between high and low pressures, such as carbon dioxide ($CO_2$), which is an example of carbonic acid gases, is used with such a rotary compressor, the pressure of the discharged refrigerant reaches 12 MPaG in the second rotary compressing unit wherein it obtained a high pressure, while the pressure thereof goes down to 8 MPaG in the first rotary compressing unit at a lower stage end to provide the intermediate pressure in the hermetic vessel. The suction pressure of the first rotary compressing unit is approximately 4 MPaG.

In the refrigerant circuit using such an internal intermediate pressure type two-stage compression rotary compressor, an evaporator develops frost, and the frost therefore has to be removed. To defrost the evaporator, if a hot refrigerant gas discharged from the second rotary compressing unit is supplied to the evaporator without reducing the pressure thereof by the decompressor (the hot refrigerant gas may be directly supplied to the evaporator or may be passed through the expansion valve or the decompressor without being decompressed therein (with the expansion valve fully open)), the suction pressure of the first rotary compressing unit rises, causing the discharging pressure (intermediate pressure) of the first rotary compressing unit to rise accordingly.

The refrigerant is introduced into the second rotary compressing unit and discharged, while it is not decompressed in the expansion valve. As a result, the discharging pressure of the second rotary compressing unit becomes equal to the suction pressure of the first rotary compressing unit. This leads to the reversion of the discharge pressure (high pressure) and the suction pressure (intermediate pressure) of the second rotary compressing unit.

The pressure reversion mentioned above can be prevented by eliminating the difference between the discharging pressure and the suction pressure in the second rotary compressing unit. This can be accomplished by letting the refrigerant gas of an intermediate pressure discharged from the first rotary compressing unit enter the evaporator without decompressing it, in addition to the refrigerant gas discharged from the second rotary compressing unit.

The vane is subjected to the urging force by a coil spring (a spring member) and the discharging pressure of the second rotary compressing unit as a back pressure. The vane is pressed against the roller mainly by the urging force of the coil spring (spring member) when the rotary compressor starts running, and by the back pressure after it starts running. However, if the refrigerant gases discharged from the first and second rotary compressing units are introduced into the evaporator to defrost the evaporator as described above, the back pressure for pressing the vane against the roller disappears. This leads to a problem in that only the urging force of the coil spring (spring member) remains, and causes the vane to detach from the roller, known as "vane jump", contributing to deteriorated durability.

The vane attached to the rotary compressor is movably inserted in a slot provided in the radial direction of the cylinder, the vane being movably inserted in the radial direction of the cylinder. At the rear end of the vane (the end adjacent to the hermetic vessel), a spring hole (housing section) that opens to the outside of the cylinder is provided. The coil spring (spring member) is inserted in the spring hole, an O-ring is inserted in the spring hole from an opening in the outside of the cylinder, and the spring hole is closed by a plug (slippage stopper) thereby to prevent the spring from jumping out.

In this case, the plug is subjected to a force in the direction in which the plug is pushed out of the spring hole by the eccentric rotation of the roller. Especially in the case of an internal intermediate pressure type rotary compressor, the pressure in the hermetic vessel becomes lower than the pressure in the cylinder of the second rotary compressing unit. Hence, the difference between the inside pressure and the outside pressure of the cylinder also tends to push the plug out. For this reason, the plug has conventionally been press-fitted into the spring hole to secure it to the cylinder. This, however, has been causing a problem in that the press-fitting deforms the cylinder such that it expands, with a consequent gap between the cylinder and a supporting member or bearing that closes the opening surface of the cylinder. Thus, the air-tightness in the cylinder cannot be secured, resulting in degraded performance of the cylinder.

To solve the problem, if, for example, the outside diameter of the plug is set to be smaller than the inside diameter of the spring hole so as to prevent the deformation of the cylinder (in this case, it is necessary to make an arrangement to prevent the plug from coming off into the hermetic vessel), then the plug would be pushed toward the spring due to the intermediate pressure in the hermetic vessel when the rotary compressor stops and the pressure at the high pressure end in the cylinder drops. As a result, the spring may be crushed and the operation may fail.

As another alternative solution, if, for example, the outside diameter of the plug is set to be larger than the inside diameter of the spring hole to an extent that would not cause the cylinder to deform, then it would be difficult to determine how far the plug should be inserted into the spring hole.

SUMMARY OF THE INVENTION

Accordingly, the present invention has been made toward solving the technological problems with the prior art, and it is an object of the invention to restrain a vane from pumping when an evaporator is defrosted in a refrigerant circuit using a so-called internal intermediate pressure type two-stage compression rotary compressor, and to provide a rotary compressor capable of restraining the vane from jumping.

It is another object of the present invention to provide a rotary compressor that has a plug provided at a predetermined position to prevent a spring for urging a vane from coming off, and is capable of preventing the deformation of a cylinder.

To these ends, according one aspect of the present invention, there is provided a defroster in a refrigerant circuit including: a rotary compressor that has a hermetic vessel housing an electromotive unit and first and second rotary compressing units driven by the electromotive unit, discharges a refrigerant gas that has been compressed by the first rotary compressing unit into the hermetic vessel, and further compresses the discharged, intermediate-pressure refrigerant gas by the second rotary compressing unit; a gas cooler into which the refrigerant discharged from the second rotary compressing unit of the rotary compressor flows; a decompressor connected to the outlet end of the gas cooler; and an evaporator connected to the outlet end of the decompressor, the refrigerant from the evaporator being compressed by the first rotary compressing unit, the rotary compressor comprising a cylinder constituting the second rotary compressing unit and a roller that is fitted to an eccentric portion formed in a rotary shaft of the electromotive unit and eccentrically rotates in the cylinder, a vane abutted against the roller to partition the interior of the cylinder into a low-pressure chamber and a high-pressure chamber, a spring for constantly urging the vane toward the roller, and a back pressure chamber for applying the discharge pressure of the second rotary compressing unit to the vane as a back pressure, wherein in order to defrost the evaporator, the defroster introduces the refrigerant gas discharged from the second rotary compressing unit into the evaporator without being decompressed by the decompressor, also introduces the refrigerant gas discharged from the first rotary compressing unit into the evaporator, drives the electromotive unit of the rotary compressor at a predetermined number of revolutions, and sets the inertial force of the vane at the predetermined number of revolutions to be smaller than the urging force of the spring.

According to another aspect of the present invention, there is provided a defroster of a refrigerant circuit including: a rotary compressor that has a hermetic vessel housing an electromotive unit and first and second rotary compressing units driven by the electromotive unit, discharges a refrigerant gas that has been compressed by the first rotary compressing unit into the hermetic vessel, and further compresses the discharged, intermediate-pressure refrigerant gas by the second rotary compressing unit; a gas cooler into which the refrigerant discharged from the second rotary compressing unit of the rotary compressor flows; a decompressor connected to the outlet end of the gas cooler; and an evaporator connected to the outlet end of the decompressor, the refrigerant from the evaporator being compressed by the first rotary compressing unit, the rotary compressor comprising a cylinder constituting the second rotary compressing unit, a roller that is fitted to an eccentric portion formed in a rotary shaft of the electromotive unit and eccentrically rotates in the cylinder, a vane abutted against the roller to partition the interior of the cylinder into a low-pressure chamber and a high-pressure chamber, a spring for constantly urging the vane toward the roller, and a back pressure chamber for applying the discharge pressure of the second rotary compressing unit to the vane as a back pressure, a defroster of the refrigerant circuit that, in order to defrost the evaporator, introduces the refrigerant gas discharged from the second rotary compressing unit into the evaporator without being decompressed by the decompressor, also introduces the refrigerant gas discharged from the first rotary compressing unit into the evaporator, and drives the electromotive unit of the rotary compressor at a number of revolutions at which the inertial force of the vane is smaller than the urging force of the spring.

According to still another aspect of the present invention, there is provided a rotary compressor that includes a hermetic vessel housing an electromotive unit and first and second rotary compressing units driven by the electromotive unit, and is used in a refrigerant circuit that discharges a refrigerant gas that has been compressed by the first rotary compressing unit into the hermetic vessel, and further compresses the discharged, intermediate-pressure refrigerant gas by the second rotary compressing unit, and includes a gas cooler into which the refrigerant discharged from the second rotary compressing unit of the rotary compressor flows, a decompressor connected to the outlet end of the gas cooler, and an evaporator connected to the outlet end of the decompressor, and drives the electromotive unit at a predetermined number of revolutions and introduces the refrigerant gases discharged from the first and second rotary compressing units into the evaporator without decompressing the refrigerant gas when defrosting the evaporator, the rotary compressor including a cylinder for constituting the second rotary compressing unit and a roller that is fitted to an eccentric portion formed in a rotary shaft of the electromotive unit and eccentrically rotates in the cylinder, a vane abutted against the roller to partition the interior of the cylinder into a low-pressure chamber and a high-pressure chamber, a spring for constantly urging the vane toward the roller, and a back pressure chamber for applying the discharge pressure of the second rotary compressing unit to the vane as a back pressure, the inertial force of the vane at the number of revolutions of the electromotive unit when defrosting the evaporator being weaker than the urging force of the spring.

With this arrangement, when the evaporator is defrosted, the refrigerant gas discharged from the second rotary compressing unit and the refrigerant gas discharged from the first rotary compressing unit are introduced into the evaporator without decompressing them. Thus, the inconvenience can be prevented in which the discharge pressure and the suction pressure of the second rotary compressing unit of the rotary compressor are reversed when the evaporator is defrosted.

Especially because the inertial force of the vane at the number of revolutions of the electromotive unit in the evaporator defrosting mode becomes smaller than the urging force of the spring, the inconvenience in which the vane jumps in the second rotary compressing unit in the evaporator defrosting mode can be also avoided. This makes it possible to defrost the evaporator without adversely affecting the durability of the rotary compressor.

According to a further aspect of the present invention, there is provided a rotary compressor that includes a hermetic vessel housing an electromotive unit and first and second rotary compressing units driven by the electromotive unit, and discharges a gas that has been compressed by the first rotary compressing unit into the hermetic vessel, and further compresses the discharged, intermediate-pressure gas by the second rotary compressing unit, the rotary compressor including a cylinder for constituting the second rotary compressing unit and a roller that is fitted to an eccentric portion formed in a rotary shaft of the electromotive unit and eccentrically rotates in the cylinder, a vane abutted against the roller to partition the interior of the cylinder into a low-pressure chamber and a high-pressure chamber, a spring for constantly urging the vane toward the roller, a housing portion for the spring that is formed in the cylinder and opens toward the vane and the hermetic vessel, and a plug provided in the housing portion so that it is positioned at the hermetic vessel end of the spring to seal the housing portion, a retaining portion against which the plug abuts at a predetermined position being formed on the inner wall of the housing portion that is positioned at the spring end of the plug.

Preferably, the outside diameter of the plug of the rotary compressor is set to be larger than the inside diameter of the housing portion to an extent that will not cause the cylinder to deform when the plug is inserted in the housing portion.

Preferably, the outside diameter of the plug of the rotary compressor is set to be smaller than the inside diameter of the housing portion.

Preferably, the retaining portion of the rotary compressor is formed such that the diameter of the inner peripheral wall of the housing portion is reduced so as to form a step on the inner peripheral wall.

Thus, the rotary compressor in accordance with the present invention includes a hermetic vessel housing an electromotive unit and first and second rotary compressing units driven by the electromotive unit, and discharges a gas that has been compressed by the first rotary compressing unit into the hermetic vessel, and further compresses the discharged, intermediate-pressure gas by the second rotary compressing unit, the rotary compressor including a cylinder for constituting the second rotary compressing unit and a roller that is fitted to an eccentric portion formed in a rotary shaft of the electromotive unit and eccentrically rotates in the cylinder, a vane abutted against the roller to partition the interior of the cylinder into a low-pressure chamber and a high-pressure chamber, a spring for constantly urging the vane toward the roller, a housing portion for the spring that is formed in the cylinder and opens toward the vane and the hermetic vessel, and a plug provided in the housing portion so that it is positioned at the hermetic vessel end of the spring to seal the housing portion, a retaining portion against which the plug abuts at a predetermined position being formed on the inner wall of the housing portion that is positioned at the spring end of the plug. Thus, the retaining portion prevents the plug from moving further toward the spring.

With this arrangement, the plug can be retained at a predetermined position. Accordingly, if, for example, the outside diameter of the plug is set to be larger than the inside diameter of the housing portion to an extent that will not cause the cylinder to deform when the plug is inserted in the housing portion, then the plug can be positioned when it is press-fitted into the housing portion while preventing the cylinder from deforming due to the insertion of the plug. This improves the ease of the installation of the plug.

If, for example, the outside diameter of the plug is set to be smaller than the inside diameter of the housing portion, then it is possible to prevent the plug from being inconveniently pushed toward the spring by the intermediate pressure in the hermetic vessel when the rotary compressor stops.

Preferably, the retaining portion is formed by reducing the diameter of the inner peripheral wall of the housing portion to form a stepped portion. This permits the retaining portion to be easily formed in the housing portion of the cylinder, resulting in reduced production cost.

Preferably, the rotary compressing units in the defroster or the rotary compressor of a refrigerant circuit in accordance with the present invention effect compression by using $CO_2$ gas as the refrigerant.

Preferably, the defroster or the rotary compressor of the refrigerant circuit in accordance with the present invention generates warm water by using the heat radiated from the gas cooler.

Thus, marked advantages are obtained especially when the $CO_2$ gas is used as the refrigerant. When warm water is produced by making use of the heat from the gas cooler, it becomes possible to convey the heat of the warm water of the gas cooler to the evaporator by the refrigerant. This provides an additional advantage in that the evaporator can be defrosted more quickly.

DESCRIPTION OF THE PREFERRED EMBODIMENTS

Figure 1:
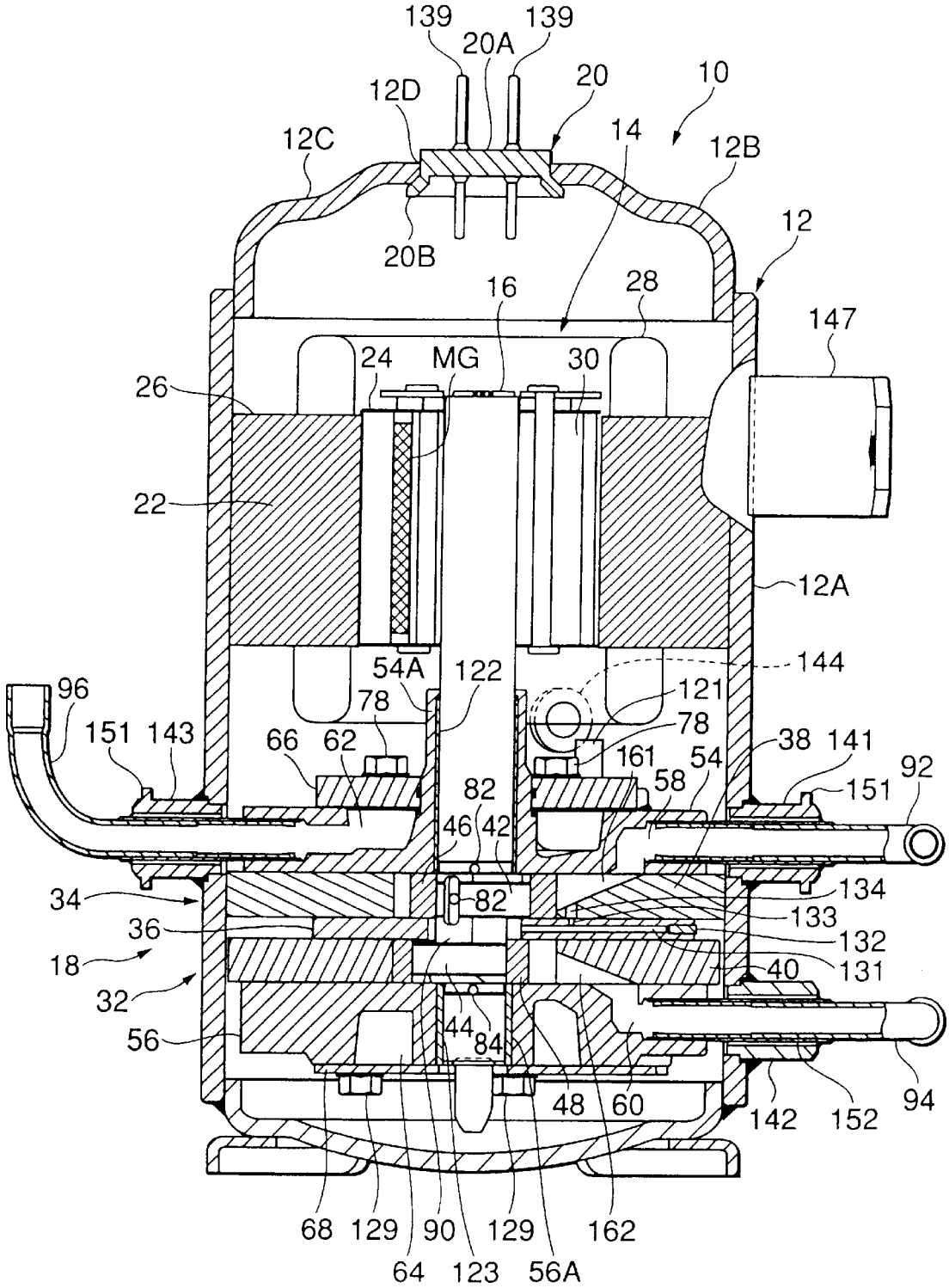
FIG. 1 is a longitudinal sectional view of a rotary compressor according to an embodiment of the present invention.

An embodiment in accordance with the present invention will now be described in conjunction with the accompanying drawings. A rotary compressor 10 shown in the drawings is an internal intermediate pressure type multi-stage compression rotary compressor that uses carbon diode ($CO_2$) as its refrigerant. The rotary compressor 10 is constructed of a cylindrical hermetic vessel 12 made of a steel plate, an electromotive unit 14 disposed and accommodated at the upper side of the internal space of the hermetic vessel 12, and a rotary compression mechanism 18 that is disposed under the electromotive unit 14 and constituted by a first rotary compressing unit 32 (1st stage) and a second rotary compressing unit 34 (2nd stage) that are driven by a rotary shaft 16 of the electromotive unit 14. The height of the rotary compressor 10 of the embodiment is 220 mm (outside diameter being 120 mm), the height of the electromotive unit 14 is about 80 mm (the outside diameter thereof being 110 mm), and the height of the rotary compression mechanism 18 is about 70 mm (the outside diameter thereof being 110 mm). The gap between the electromotive unit 14 and the rotary compression mechanism 18 is about 5 mm. The excluded volume of the second rotary compressing unit 34 is set to be smaller than the excluded volume of the first rotary compressing unit 32.

The hermetic vessel 12 according to this embodiment is formed of a steel plate having a thickness of 4.5 mm, and has an oil reservoir at its bottom, a vessel main body 12A for housing the electromotive unit 14 and the rotary compression mechanism 18, and a substantially bowl-shaped end cap (cover) 12B for closing the upper opening of the vessel main body 12A. A round mounting hole 12D is formed at the center of the top surface of the end cap 12B, and a terminal (the wire being omitted) 20 for supply power to the electromotive unit 14 is installed to the mounting hole 12D.

In this case, the end cap 12B surrounding the terminal 20 is provided with an annular stepped portion 12C having a predetermined curvature that is formed by molding. The terminal 20 is constructed of a round glass portion 20A having electrical terminals 139 penetrating it, and a metallic mounting portion 20B formed around the glass portion 20A and extends like a jaw aslant downward and outward. The thickness of the mounting portion 20B is set to 2.4±0.5 mm. The terminal 20 is secured to the end cap 12B by inserting the glass portion 20A from below into the mounting hole 12D to jut it out to the upper side, and abutting the mounting portion 20B against the periphery of the mounting hole 12D, then welding the mounting portion 20B to the periphery of the mounting hole 12D of the end cap 12B.

The electromotive unit 14 is formed of a stator 22 annularly installed along the inner peripheral surface of the upper space of the hermetic vessel 12 and a rotor 24 inserted in the stator 22 with a slight gap provided therebetween. The rotor 24 is secured to the rotary shaft 16 that passes through the center thereof and extends in the perpendicular direction.

Figure 6:
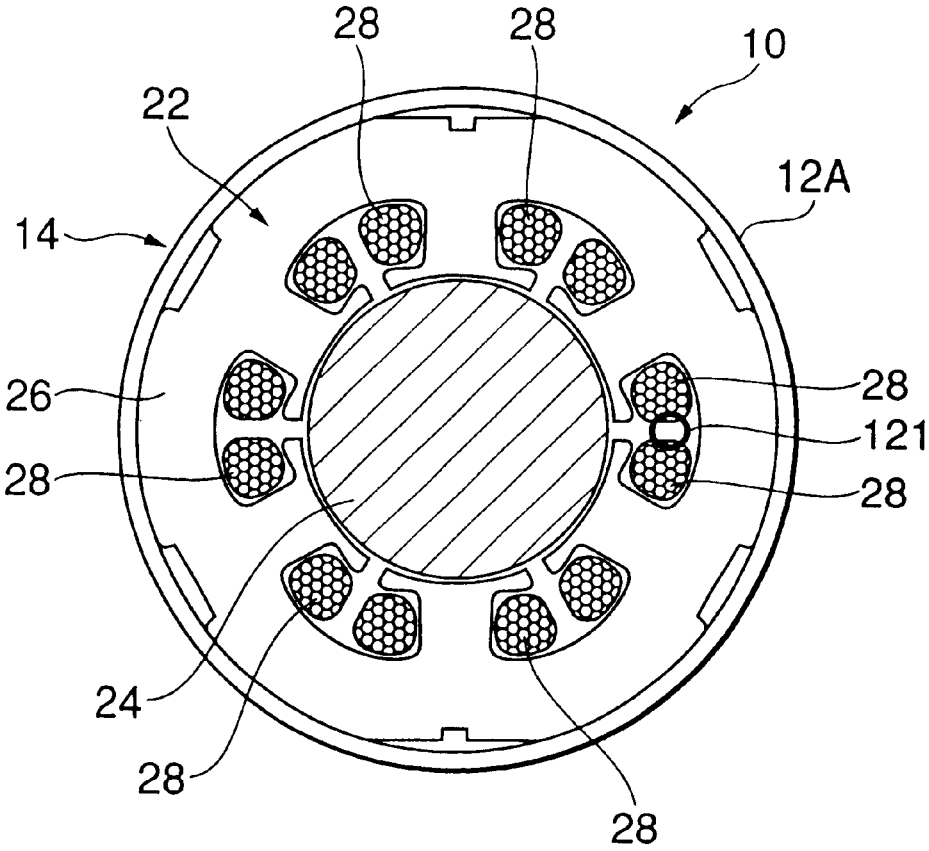
FIG. 6 is a top sectional view of an electromotive unit of the rotary compressor shown in FIG. 1.

The stator 22 has a laminate 26 formed of stacked donut-shaped electromagnetic steel plates, and a stator coil 28 wound around the teeth of the laminate 26 by series winding or concentrated winding, as shown in FIG. 6. As in the case of the stator 22, the rotor 24 is formed also of a laminate 30 made of electromagnetic steel plates, and a permanent magnet MG is inserted in the laminate 30.

An intermediate partitioner 36 is sandwiched between the first rotary compressing unit 32 and the second rotary compressing unit 34. More specifically, the first rotary compressing unit 32 and the second rotary compressing unit 34 are constructed of the intermediate partitioner 36, a cylinder 38 and a cylinder 40 disposed on and under the intermediate partitioner 36, upper and lower rollers 46 and 48 that eccentrically rotate in the upper and lower cylinders 38 and 40 with a 180-degree phase difference by being fitted to upper and lower eccentric portions 42 and 44 provided on the rotary shaft 16, upper and lower vanes 50 (the lower vane being not shown) that abut against the upper and lower rollers 46 and 48 to partition the interiors of the upper and lower cylinders 38 and 40 into low-pressure chambers and high-pressure chambers, as it will be discussed hereinafter, and an upper supporting member 54 and a lower supporting member 56 serving also as the bearings of the rotary shaft 16 by closing the upper open surface of the upper cylinder 38 and the bottom open surface of the lower cylinder 40.

The upper supporting member 54 and the lower supporting member 56 are provided with suction passages 58 and 60 in communication with the interiors of the upper and lower cylinders 38 and 40, respectively, through suction ports 161 and 162, and recessed discharge muffling chambers 62 and 64. The open portions of the two discharge muffling chambers 62 and 64 are closed by covers. More specifically, the discharge muffling chamber 62 is closed by an upper cover 66, and the discharge muffling chamber 64 is closed by a lower cover 68.

In this case, a bearing 54A is formed upright at the center of the upper supporting member 54, and a cylindrical bush 122 is installed to the inner surface of the bearing 54A. Furthermore, a bearing 56A is formed in a penetrating fashion at the center of the lower supporting member 56. A cylindrical bush 123 is attached to the inner surface of the bearing 56A also. These bushes 122 and 123 are made of a material exhibiting good slidability, as it will be discussed hereinafter, and the rotary shaft 16 is retained by a bearing 54A of the upper supporting member 54 and a bearing 56A of the lower supporting member 56 through the intermediary of the bushes 122 and 123.

Figure 9:
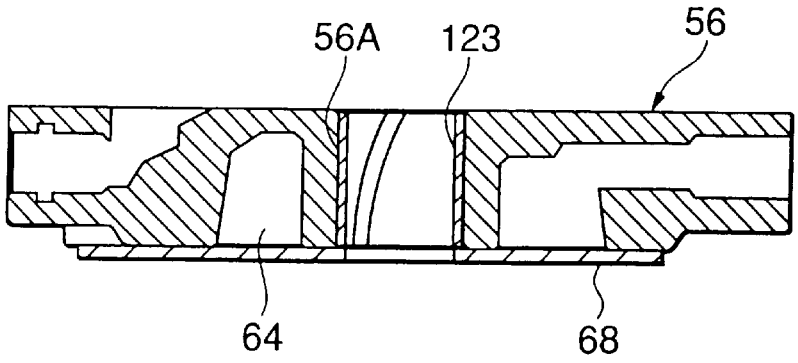
FIG. 9 is a sectional view of a lower supporting member and a lower cover of the rotary compressor shown in FIG. 1.
Figure 10:
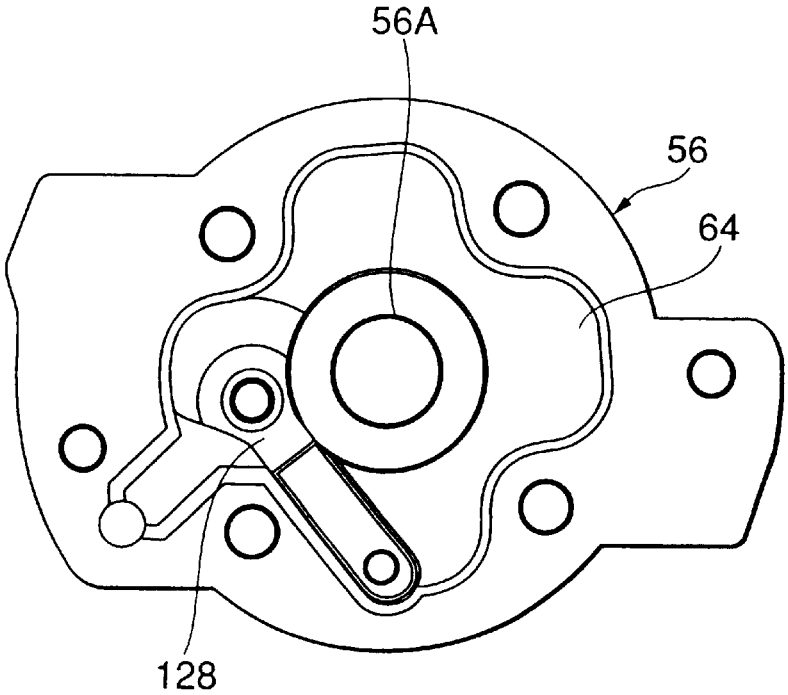
FIG. 10 is a bottom view of the lower supporting member of the rotary compressor shown in FIG. 1.

In this case, the lower cover 68 is formed of a donut-shaped round steel plate, and secured to the lower supporting member 56 from below by main bolts 129 at four points on its peripheral portion. The lower cover 68 closes the bottom open portion of the discharge muffling chamber 64 in communication with the interior of the lower cylinder 40 of the first rotary compressing unit 32 through a discharge port 41. The distal ends of the main bolts 129 are screwed to the upper supporting members 54. The inner periphery of the lower cover 68 projects inward beyond the inner surface of the bearing 56A of the lower supporting member 56 so as to retain the bottom end surface of the bush 123 by the lower cover 68 to prevent it from coming off (FIG. 9). FIG. 10 shows the bottom surface of the lower supporting member 56, reference numeral 128 denoting a discharge valve of the first rotary compressing unit 32 that opens and closes the discharge port 41 in the discharge muffling chamber 64.

The lower supporting member 56 is formed of a ferrous sintered material (or castings), and its surface (lower surface) to which the lower cover 68 is attached is machined to have a flatness of 0.1 mm or less, then subjected to steaming treatment. The steaming treatment causes the ferrous surface to which the lower cover 68 is attached to an iron oxide surface, so that the pores inside the sintered material are closed, leading to improved sealing performance. This obviates the need for providing a gasket between the lower cover 68 and the lower supporting member 56.

Figure 4:
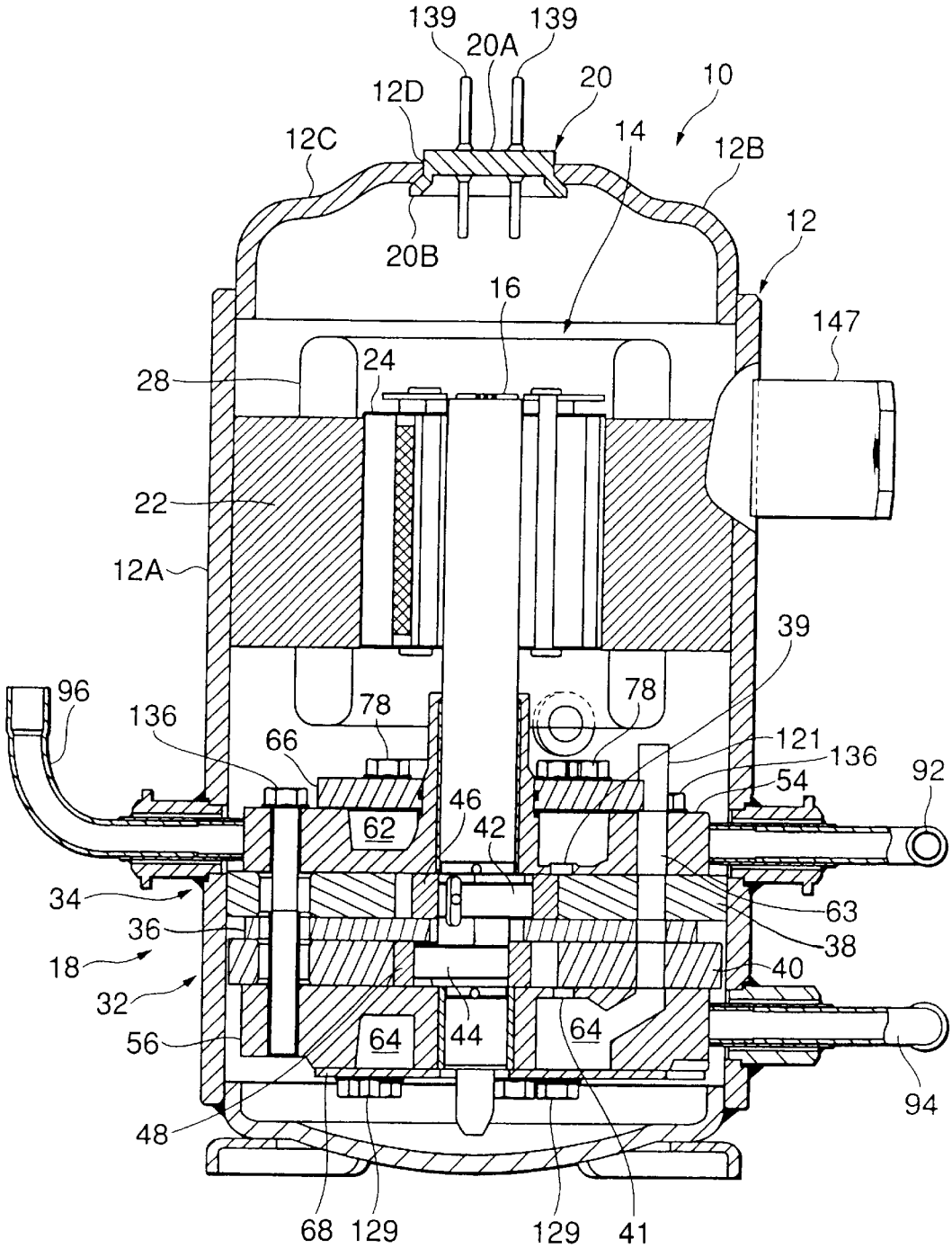
FIG. 4 is another longitudinal sectional view of the rotary compressor shown in FIG. 1.
Figure 5:
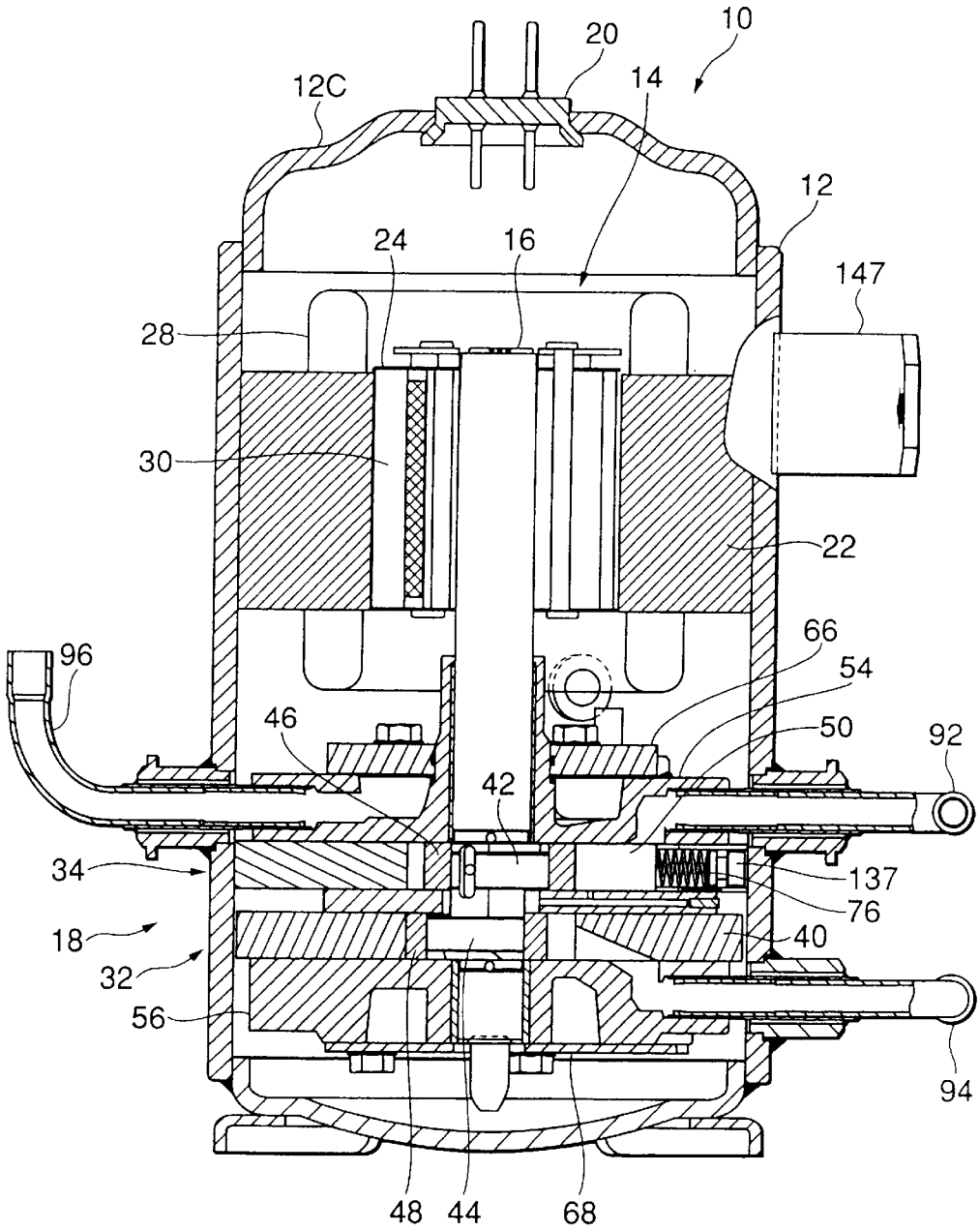
FIG. 5 is still another longitudinal sectional view of the rotary compressor shown in FIG. 1.

The discharge muffling chamber 64 and the upper cover 66 at the side adjacent to the electromotive unit 14 in the interior of the hermetic vessel 12 are in communication with each other through a communicating passage 63, which is a hole passing through the upper and lower cylinders 38 and 40 and the intermediate partitioner 36 (FIG. 4). In this case, an intermediate discharge pipe 121 is provided upright at the upper end of the communicating passage 63. The intermediate discharge pipe 121 is directed to the gap between adjoining stator coils 28 and 28 wound around the stator 22 of the electromotive unit 14 located above (FIG. 6).

Figure 11:
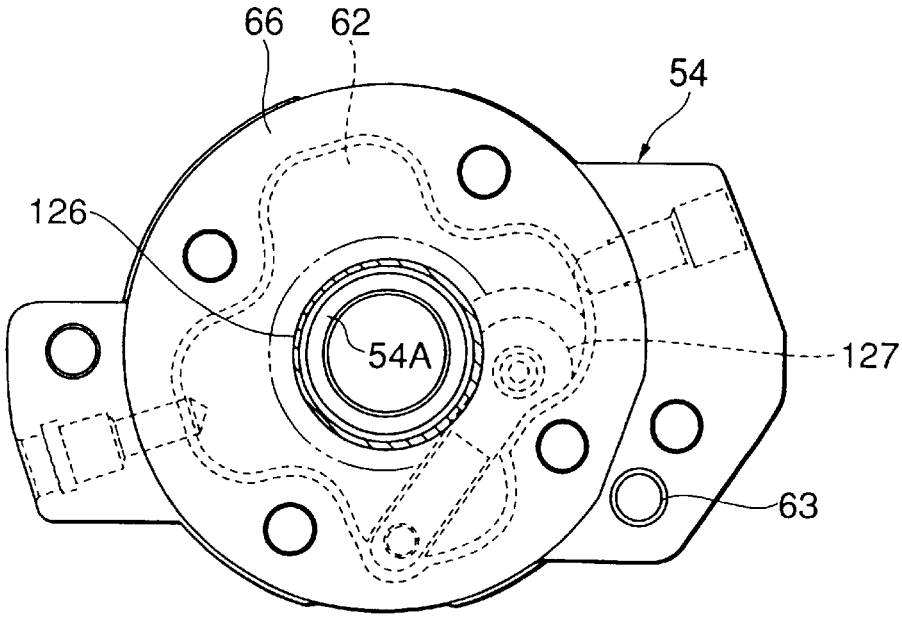
FIG. 11 is a top view of an upper supporting member and an upper cover of the rotary compressor shown in FIG. 1.

The upper cover 66 closes the upper surface opening of the discharge muffling chamber 62 in communication with the interior of the upper cylinder 38 of the second rotary compressing unit 34 through a discharge port 39, and partitions the interior of the hermetic vessel 12 to the discharge muffling chamber 62 and a chamber adjacent to the electromotive unit 14. As shown in FIG. 11, the upper cover 66 has a thickness of 2 mm or more and 10 mm or less (the thickness being set to the most preferable value, 6 mm, in this embodiment), and is formed of a substantially donut-shaped, circular steel plate having a hole through which the bearing 54A of the upper supporting member 54 penetrates. With a gasket 124 sandwiched between the upper cover 66 and the upper supporting member 54, the peripheral portion of the upper cover 66 is secured from above to the upper supporting member 54 by four main bolts 78 through the intermediary of the gasket 124. The distal ends of the main bolts 78 are screwed to the lower supporting member 56.

Figure 12:
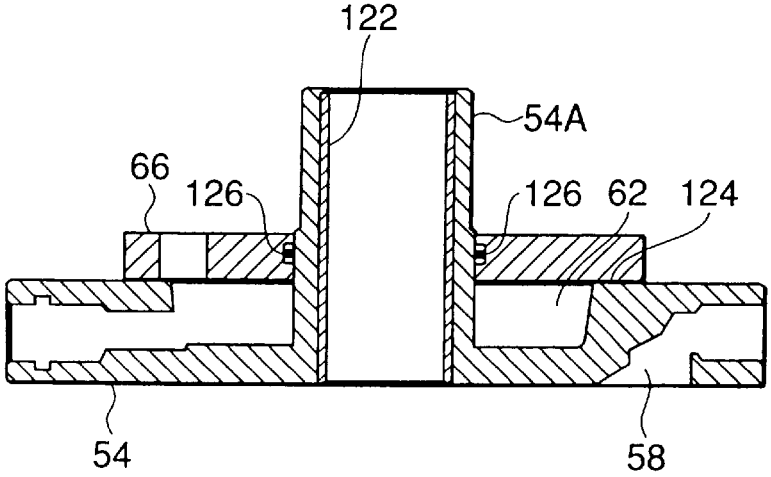
FIG. 12 is a sectional view of the upper supporting member and the upper cover of the rotary compressor shown in FIG. 1.

Setting the thickness of the upper cover 66 to such a dimensional range makes it possible to achieve a reduced size, durability that is sufficiently high to survive the pressure of the discharge muffling chamber 62 that becomes higher than that of the interior of the hermetic vessel 12, and a secured insulating distance from the electromotive unit 14. Furthermore, an O-ring 126 is provided between the inner periphery of the upper cover 66 and the outer surface of the bearing 54A (FIG. 12). The O-ring 126 seals the bearing 54A so as to provide adequate sealing at the inner periphery of the upper cover 66. This arrangement makes it possible to prevent gas leakage, increase the volume of the discharge muffling chamber 62, and obviate the need for installing a C-ring to secure the inner periphery of the upper cover 66 to the bearing 54A. Reference numeral 127 shown in FIG. 11 denotes a discharge valve of the second rotary compressing unit 34 that opens and closes the discharge port 39 in the discharge muffling chamber 62.

Figure 13:
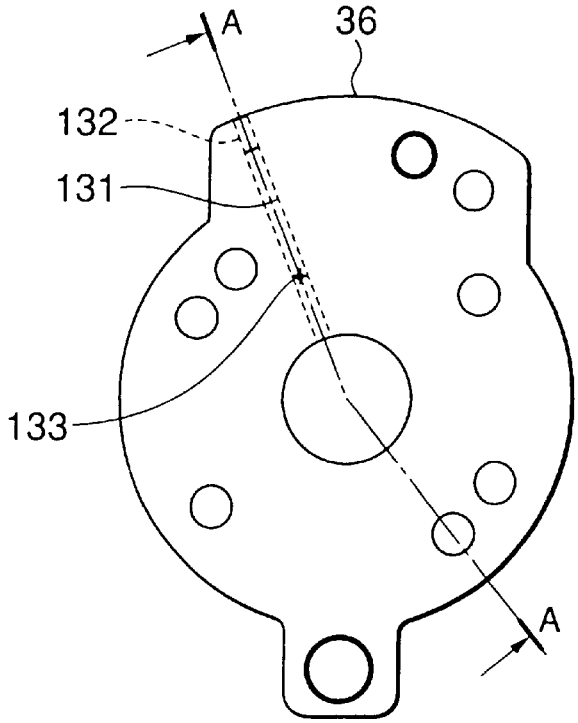
FIG. 13 is a top view of an intermediate partitioner of the rotary compressor shown in FIG. 1.
Figure 14:
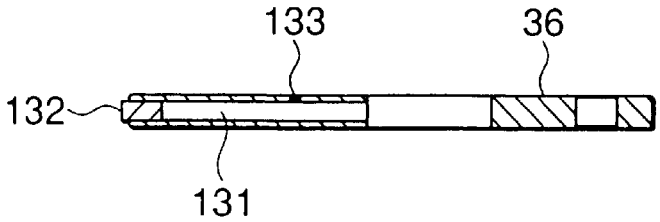
FIG. 14 is a sectional view taken at the line A—A shown in FIG. 13.
Figure 15:
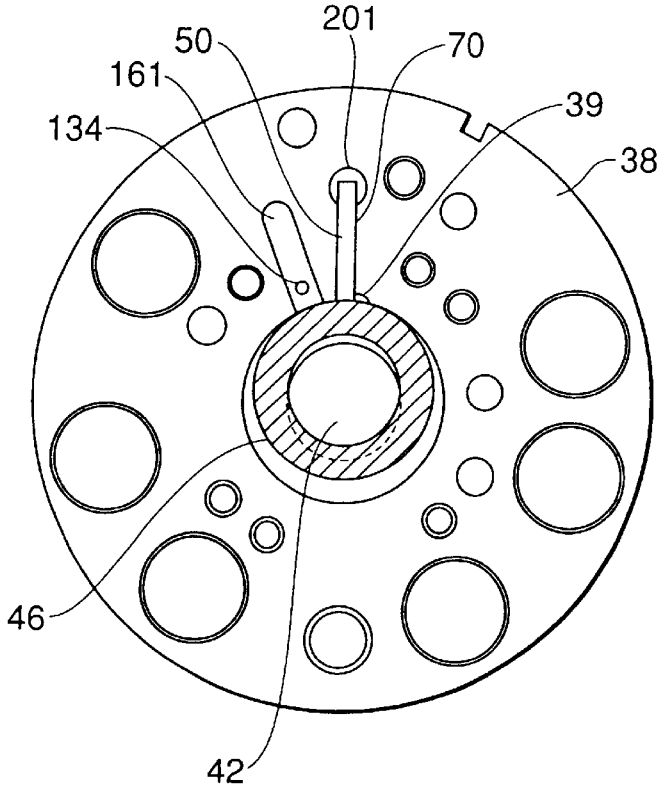
FIG. 15 is a top view of an upper cylinder of the rotary compressor shown in FIG. 1.

The intermediate partitioner 36 that closes the lower open surface of the upper cylinder 38 and the upper open surface of the lower cylinder 40 has a through hole 131 that is located at the position corresponding to the suction side in the upper cylinder 38 and extends from the outer peripheral surface to the inner peripheral surface to establish communication between the outer peripheral surface and the inner peripheral surface thereby to constitute an oil feeding passage, as shown in FIGS. 13 and 14. A sealing member 132 is press-fitted to the outer peripheral surface of the through hole 131 to seal the opening in the outer peripheral surface. Furthermore, a communication hole 133 extending upward is formed in the middle of the through hole 131.

Figure 7:
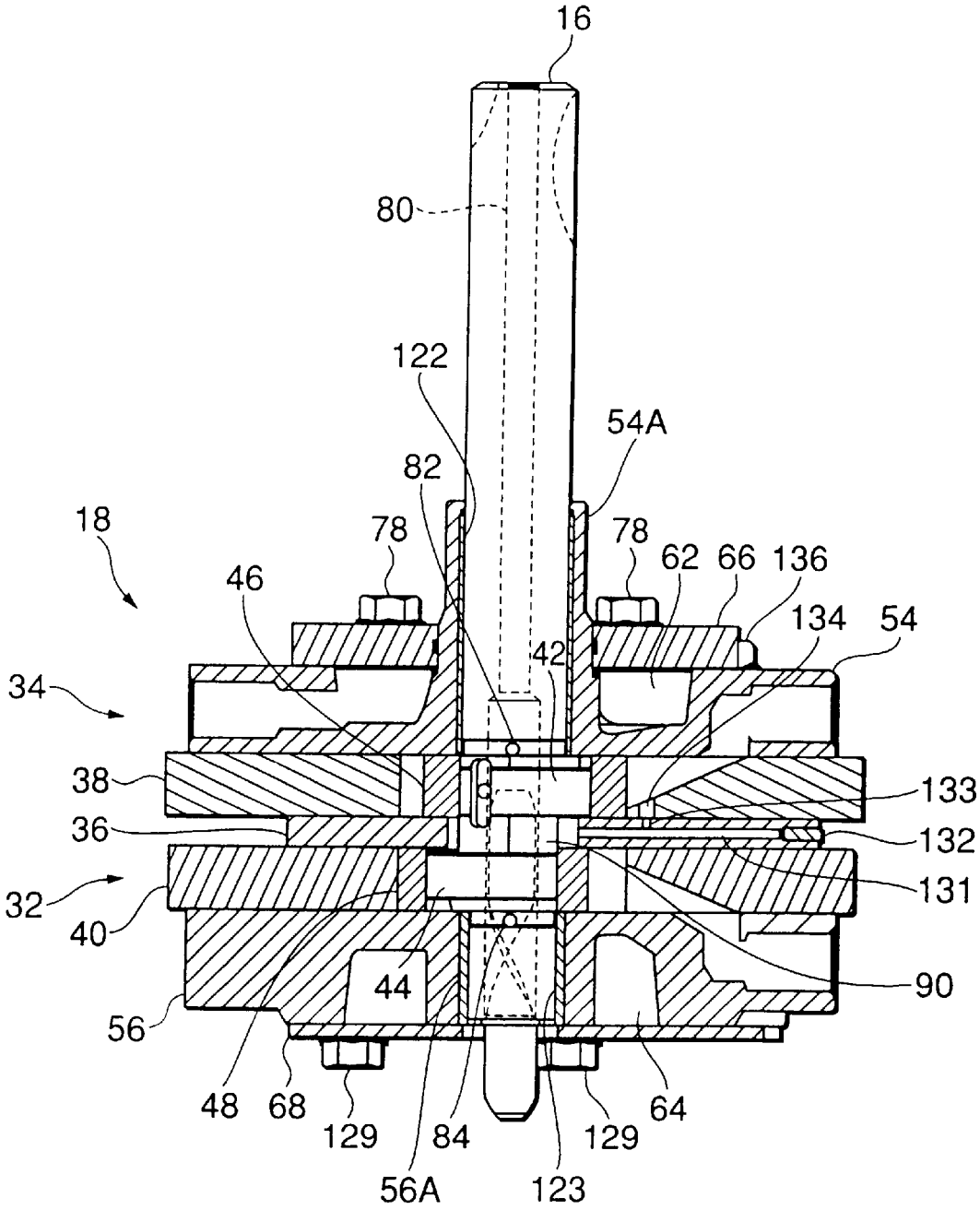
FIG. 7 is an enlarged sectional view of a rotary compressing mechanism of the rotary compressor shown in FIG. 1.

In addition, a communication hole 134 linked to the communication hole 133 of the intermediate partitioner 36 is opened in the suction port 161 (suction side) of the upper cylinder 38. The rotary shaft 16 has an oil hole 80 oriented perpendicularly to the axial center and horizontal oil feeding holes 82 and 84 (being also formed in the upper and lower eccentric portions 42 and 44 of the rotary shaft 16) in communication with the oil hole 80, as shown in FIG. 7. The opening at the inner peripheral surface side of the through hole 131 of the intermediate partitioner 36 is in communication with the oil hole 80 through the intermediary of the oil feeding holes 82 and 84.

As it will be discussed hereinafter, the pressure inside the hermetic vessel 12 will be an intermediate pressure, so that it will be difficult to supply oil into the upper cylinder 38 that will have a high pressure due to the second stage. However, the construction of the intermediate partitioner 36 makes it possible to draw up the oil from the oil reservoir at the bottom in the hermetic vessel 12, lead it up through the oil hole 80 to the oil feeding holes 82 and 84 into the through hole 131 of the intermediate petitioner 36, and supply the oil to the suction side of the upper cylinder 38 (the suction port 161) through the communication holes 133 and 134.

Figure 16:
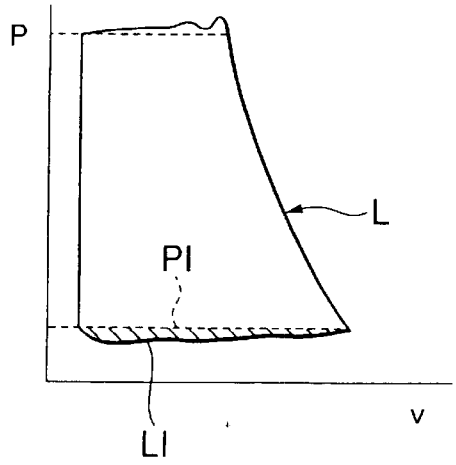
FIG. 16 is a diagram illustrating the fluctuation in the pressure at the suction side of the upper cylinder of the rotary compressor shown in FIG. 1.

Referring now to FIG. 16, L denotes the changes in the pressure at the suction side of the upper cylinder 38, and P1 denotes the pressure at the inner peripheral surface of the intermediate partitioner 36. As indicated by L1 in the graph, the pressure, that is, the suction pressure, at the suction side of the upper cylinder 38 becomes lower than the pressure at the inner peripheral surface of the intermediate partitioner 36 due to a suction pressure loss during a suction stroke. During this period of time, oil is supplied from the through hole 131 of the intermediate partitioner 36 and the communication hole 133 into the upper cylinder 38 through the communication hole 134 of the upper cylinder 38.

As described above, the upper and lower cylinders 38, 40, the intermediate partitioners 36, the upper and lower supporting members 54, 56, and the upper and lower covers 66, 68 are vertically fastened by four main bolts 78 and the main bolts 129. Furthermore, the upper and lower cylinders 38, 40, the intermediate partitioner 36, and the upper and lower supporting members 54, 56 are fastened by auxiliary bolts 136, 136 located outside the main bolts 78, 129 (FIG. 4). The auxiliary bolts 136 are inserted from the upper supporting member 54, and the distal ends thereof are screwed to the lower supporting member 56.

The auxiliary bolts 136 are positioned in the vicinity of a guide groove 70 (to be discussed later) of the foregoing vane 50. The addition of the auxiliary bolts 136, 136 to integrate the rotary compression mechanism 18 secures the sealing performance against an extremely high internal pressure. Moreover, the fastening is effected in the vicinity of the guide groove 70 of the vane 50, thus making it possible to also prevent the leakage of the high back pressure (the pressure in a back pressure chamber 201) applied to the vane 50, as it will be discussed hereinafter.

Figure 8:
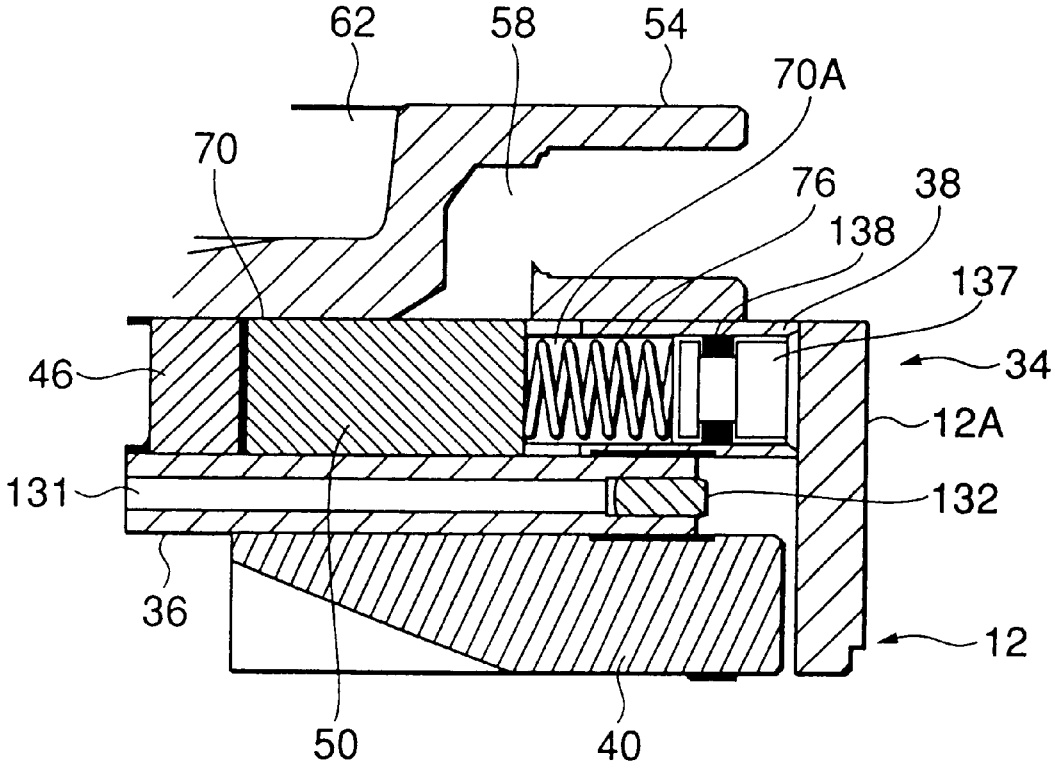
FIG. 8 is an enlarged sectional view of a vane of a second rotary compressing unit of the rotary compressor shown in FIG. 1.

The upper cylinder 38 incorporates a guide groove 70 accommodating the vane 50, and an housing portion 70A for housing a spring 76 positioned outside the guide groove 70, the housing portion 70A being opened to the guide groove 70 and the hermetic vessel 12 or the vessel main body 12A, as shown in FIG. 8. The spring 76 abuts against the outer end portion of the vane 50 to constantly urge the vane 50 toward the roller 46. A metallic plug 137 is press-fitted through the opening at the outer side (adjacent to the hermetic vessel 12) of the housing portion 70A into the housing portion 70A for the spring 76 at the end adjacent to the hermetic vessel 12. The plug 137 functions to prevent the spring 76 from coming off.

In this case, the outside diameter of the plug 137 is set to value that does not cause the upper cylinder 38 to deform when the plug 137 is press-fitted into the housing portion 70A, while the value is larger than the inside diameter of the housing portion 70A at the same time. More specifically, in the embodiment, the outside diameter of the plug 137 is designed to be larger than the inside diameter of the housing portion 70A by 4 $\mu$m to 23 $\mu$m. An O-ring 138 for sealing the gap between the plug 137 and the inner surface of the housing portion 70A is attached to the peripheral surface of the plug 137.

Figure 22:
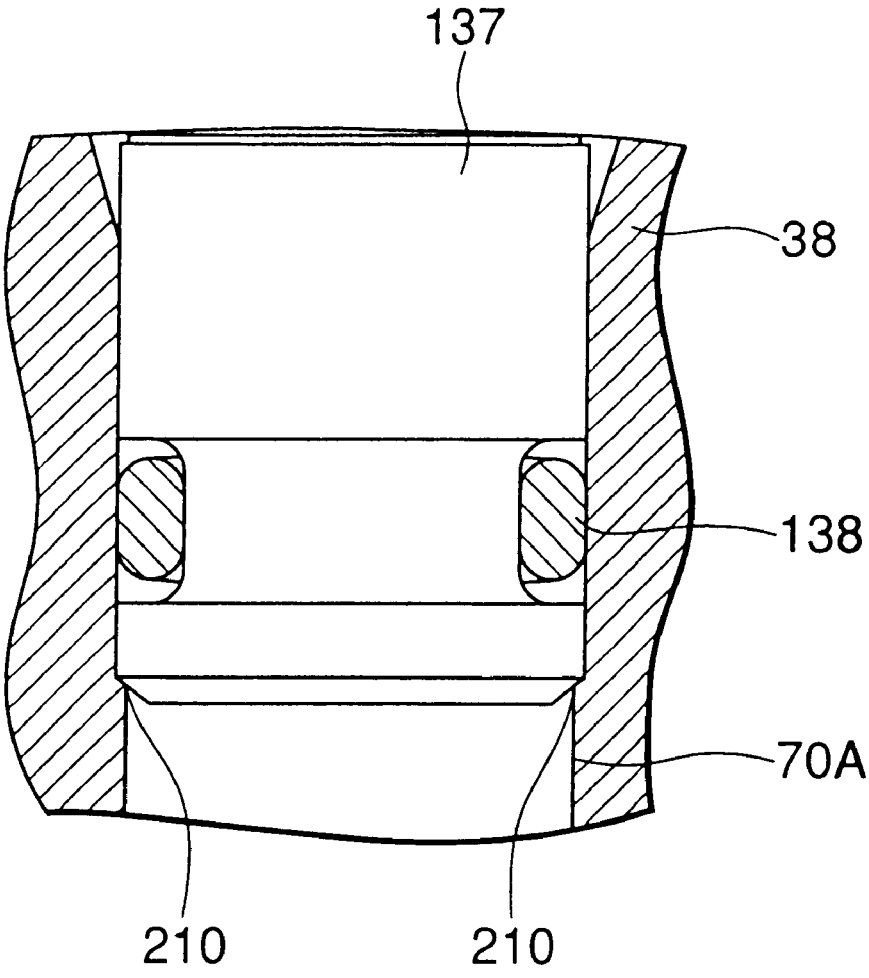
FIG. 22 is an enlarged sectional view of a plug of a second rotary compressing unit of the rotary compressor shown in FIG. 1.

As shown in the enlarged view of FIG. 22, at the places of the housing portion 70A where the ends (inner ends) of the plug 137 adjacent to the spring 76, a stopper 210 are formed, against which the inner end of the plug 137 abuts when the plug 137 is press-fitted until the outer end of the plug 137 reaches a predetermined position at the opening end (the outer end of the housing portion 70A) on the outer side (adjacent to the hermetic vessel 12) of the housing portion 70A. The stopper 210 is formed when the upper cylinder 38 is machine to form the housing portion 70A. To form the stopper 210, the inner peripheral wall of the housing portion 70A is reduced to make a stepped portion by using a drill for machining a smaller hole for drilling the inner diameter hole of the housing portion 70A at the inner side (adjacent to the vane 50).

The outer end of the upper cylinder 38, that is, the interval between the outer end of the housing portion 70A and the vessel main body 12A of the hermetic vessel 12 is set to be smaller than the distance from the O-ring 138 to the outer end of the plug 137 (the end adjacent to the hermetic vessel 12). The back pressure chamber (not shown) in communication with the guide groove 70 of the vane 50 is subjected to a high pressure, as a back pressure, which is the discharge pressure of the second rotary compressing unit 34. Hence, the end of the plug 137 adjacent to the spring 76 will have a high pressure, whereas the end thereof adjacent to the hermetic vessel 12 will have an intermediate pressure.

Establishing the aforesaid dimensional relationship between the plug 137 and the housing portion 70A makes it possible to prevent the problem in that the upper cylinder 38 deforms due to the press-fitting of the plug 137, and the sealing with respect to the upper supporting member 54 is deteriorated, resulting in degraded performance. Moreover, according to the construction described above, when the plug 137 is press-fitted through the opening on the outer side of the housing portion 70A until it reaches the predetermined position (when the outer end of the plug 137 reaches the edge of the opening on the outer side of the housing portion 70A) shown in FIG. 22, the plug 137 abuts against the stopper 210 and can no longer be press-fitted, so that the plug 137 can be positioned when it is press-fitted into the housing portion 70A, permitting easier installation of the plug 137. Especially because the danger of excessively press-fitting the plug 137, the deformation of the upper cylinder 38 caused by forcible press-fitting can be prevented.

Figure 17:
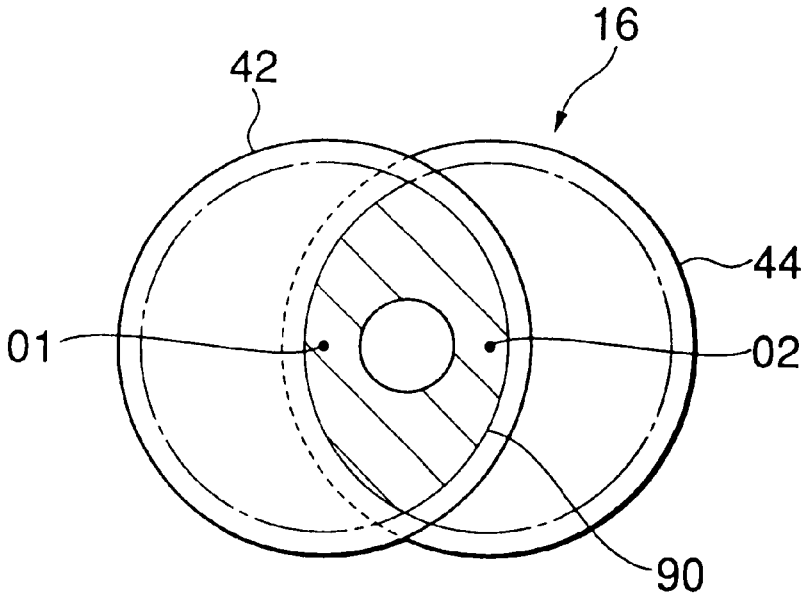
FIG. 17 is a sectional view illustrating the shape of the joint of a rotary shaft of the rotary compressor shown in FIG. 1.

A coupling portion 90 for coupling the upper and lower eccentric portions 42 and 44 together that are formed integrally with the rotary shaft 16 with a 180-degree phase difference has a non-circular shape, such as a shape like a rugby ball, in order to set its sectional area larger than the round section of the rotary shaft 16 so as to secure rigidity (FIG. 17). More specifically, the section of the coupling portion 90 for connecting the upper and lower eccentric portions 42 and 44 provided on the rotary shaft 16 is formed to increase its thickness in the direction orthogonal to the eccentric direction of the upper and lower eccentric portions 42 and 44 (refer to the hatched area in FIG. 17).

Thus, the sectional area of the coupling portion 90 connecting the upper and lower eccentric portions 42 and 44 integrally provided on the rotary shaft 16 increases, so that the sectional secondary moment is increased to enhance the strength or rigidity, leading to higher durability and reliability. Especially when a refrigerant having a high operating pressure is compressed in two stages, the load applied to the rotary shaft 16 will be increased due to the increased difference between the high and low pressures; however, the coupling portion 90 having the larger sectional area with consequent greater strength or rigidity will be able to restrain the rotary shaft 16 from elastically deforming.

In this case, if the center of the upper eccentric portion 42 is denoted as O1, and the center of the lower eccentric portion 44 is denoted as O2, then the center of the arc of the surface of the coupling portion 90 in the eccentric direction of the eccentric portion 42 will be O1, and the center of the arc of the surface of the coupling portion 90 in the eccentric direction of the eccentric portion 44 will be O2. Thus, when chucking the rotary shaft 16 onto a cutting machine to form the upper and lower eccentric portions 42, 44 and the coupling portion 90, it is possible to machine the eccentric portion 42, then to change only the radius to machine one surface of the coupling portion 90. After that, the chucking position is changed to machine the other surface of the coupling portion 90, and only the radius is changed to machine the eccentric portion 44. This will reduce the number of times of re-chucking the rotary shaft 16, and the productivity can be markedly improved.

In this case, as the refrigerant, the foregoing carbon dioxide ($CO_2$), an example of carbonic acid gas, which is a natural refrigerant is used primarily because it is gentle to the earth and less flammable and toxic. For the oil functioning as a lubricant, an existing oil, such as mineral oil, alkylbenzene oil, ether oil, or ester oil is used.

On a side surface of the vessel main body 12A of the hermetic vessel 12, sleeves 141, 142, 143, and 144 are respectively fixed by welding at the positions corresponding to the positions of the suction passages 58 and 60 of the upper supporting member 54 and the lower supporting member 56, the discharge muffling chamber 62, and the upper side of the upper cover 66 (the position substantially corresponding to the bottom end of the electromotive unit 14). The sleeves 141 and 142 are vertically adjacent, and the sleeve 143 is located on a substantially diagonal line of the sleeve 141. The sleeve 144 is located at a position shifted substantially 90 degrees from the sleeve 141.

One end of a refrigerant introducing pipe 92 for leading a refrigerant gas into the upper cylinder 38 is inserted into the sleeve 141, and the one end of the refrigerant introducing pipe 92 is in communication with the suction passage 58 of the upper cylinder 38. The refrigerant introducing pipe 92 passes the upper side of the hermetic vessel 12 and reaches the sleeve 144, and the other end thereof is inserted in and connected to the sleeve 144 to be in communication with the interior of the hermetic vessel 12.

Furthermore, one end of a refrigerant introducing pipe 94 for leading a refrigerant gas into the lower cylinder 40 is inserted in and connected to the sleeve 142, and the one end of the refrigerant introducing pipe 94 is in communication with the suction passage 60 of the lower cylinder 40. The other end of the refrigerant introducing pipe 94 is connected to the bottom end of an accumulator 146. A refrigerant discharge pipe 96 is inserted in and connected to the sleeve 143, and one end of the refrigerant discharge pipe 96 is in communication with the discharge muffling chamber 62.

Figure 3:
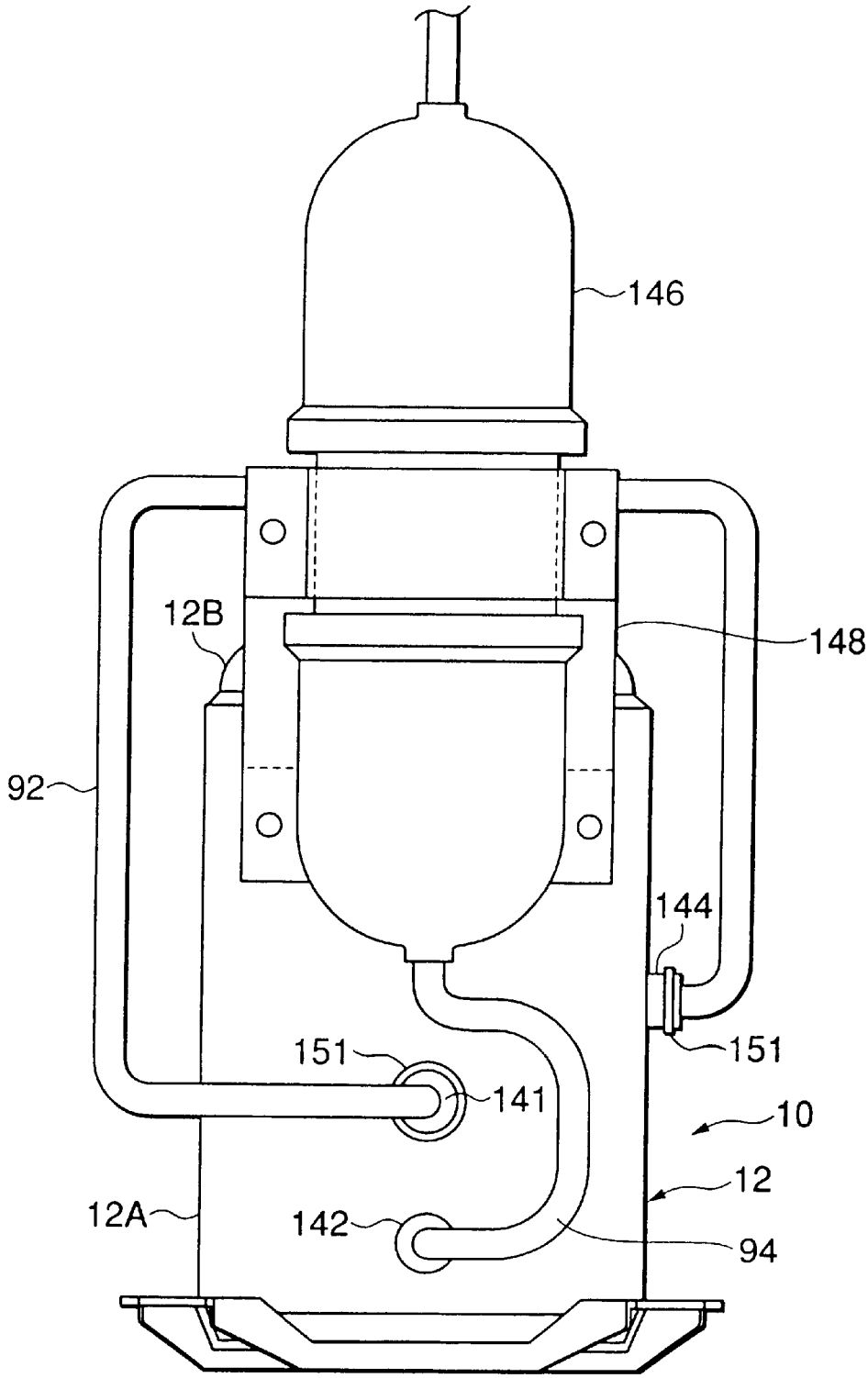
FIG. 3 is a side view of the rotary compressor shown in FIG. 1.

The above accumulator 146 is a tank for separating gas from liquid of an introduced refrigerant. The accumulator 146 is installed, through the intermediary of a bracket 148 adjacent to the accumulator, to a bracket 147 adjacent to the hermetic vessel that is secured by welding to the upper side surface of the vessel main body 12A of the hermetic vessel 12. The bracket 148 extends upward from the bracket 147 to retain the substantially vertical central portion of the accumulator 146. In this layout, the accumulator 146 is disposed along the side of the hermetic vessel 12. The refrigerant introducing pipe 92 is extended out of the sleeve 141, bent rightward in this embodiment, then routed upward. The bottom end of the accumulator 146 is adjacent to the refrigerant introducing pipe 92. A refrigerant introducing pipe 94 directed downward from the bottom end of the accumulator 146 is routed such that it reaches the sleeve 42, bypassing the left side, which is opposite from the bending direction of the refrigerant introducing pipe 92 as observed from the sleeve 141 (FIG. 3).

More specifically, the refrigerant introducing pipes 92 and 94 in communication with the suction passages 58 and 60, respectively, of the upper supporting member 38 and the lower supporting member 40 are bent in a horizontally opposite direction as observed from the hermetic vessel 12. This arrangement restrains the refrigerant introducing pipes 92 and 94 from interfering with each other if the vertical dimension of the accumulator 146 is increased to increase the volume.

Furthermore, collars 151 with which couplers for pipe connection can be engaged are disposed around the outer surfaces of the sleeves 141, 143, and 144. The inner surface of the sleeve 142 is provided with a thread groove 152 for pipe connection. This allows the couplers for test pipes to be easily connected to the collars 151 of the sleeves 141, 143, and 144 to carry out an airtightness test in the final inspection in the manufacturing process of the compressor 10. In addition, the thread groove 152 allows a test pipe to be easily screwed into the sleeve 142. Especially in the case of the vertically adjoining sleeves 141 and 142, the sleeve 141 has the collar 151, while the sleeve 142 has a thread groove 152, so that test pipes can be connected to the sleeves 141 and 142 in a small space.

Figure 2:
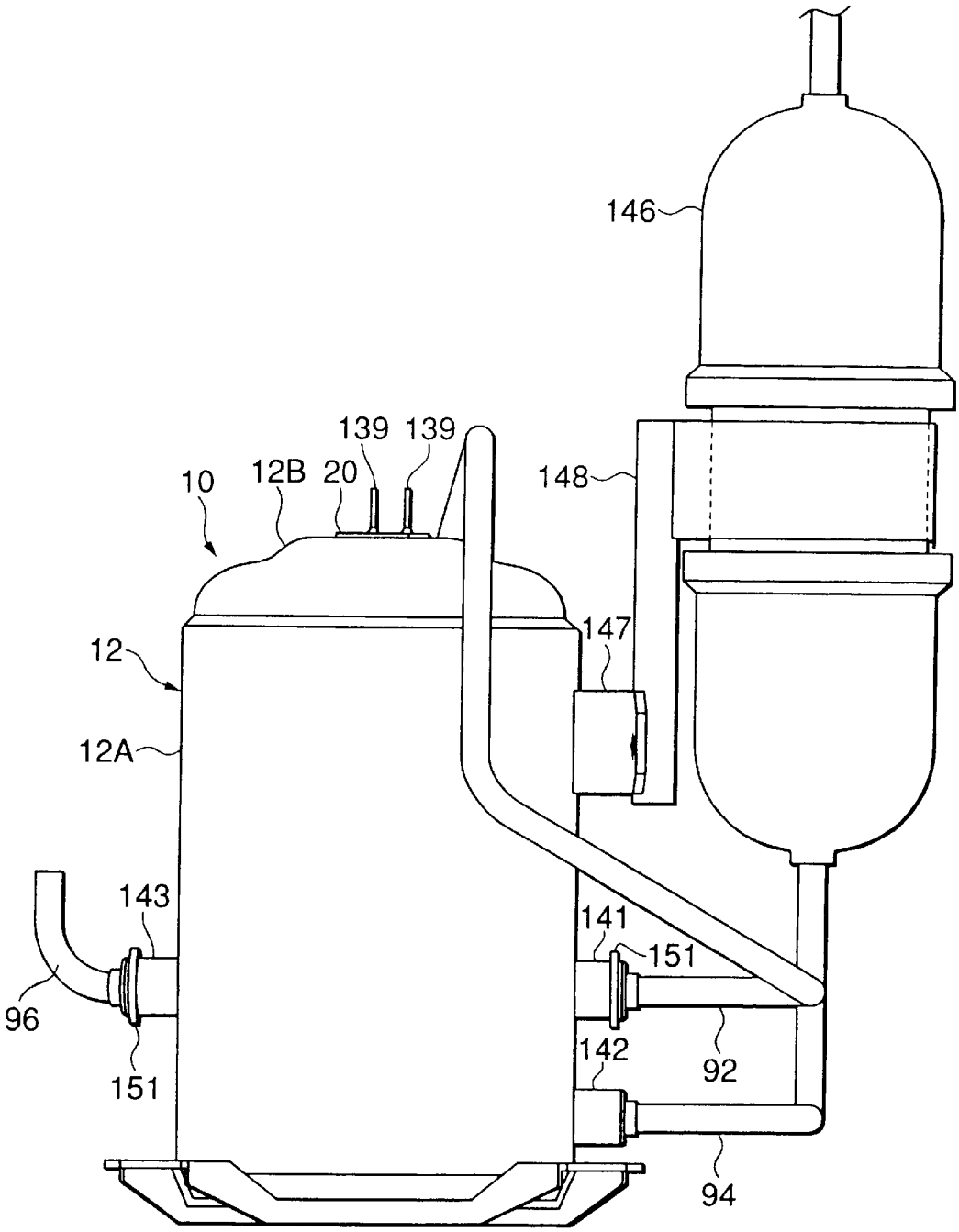
FIG. 2 is a front view of the rotary compressor shown in FIG. 1.
Figure 18:
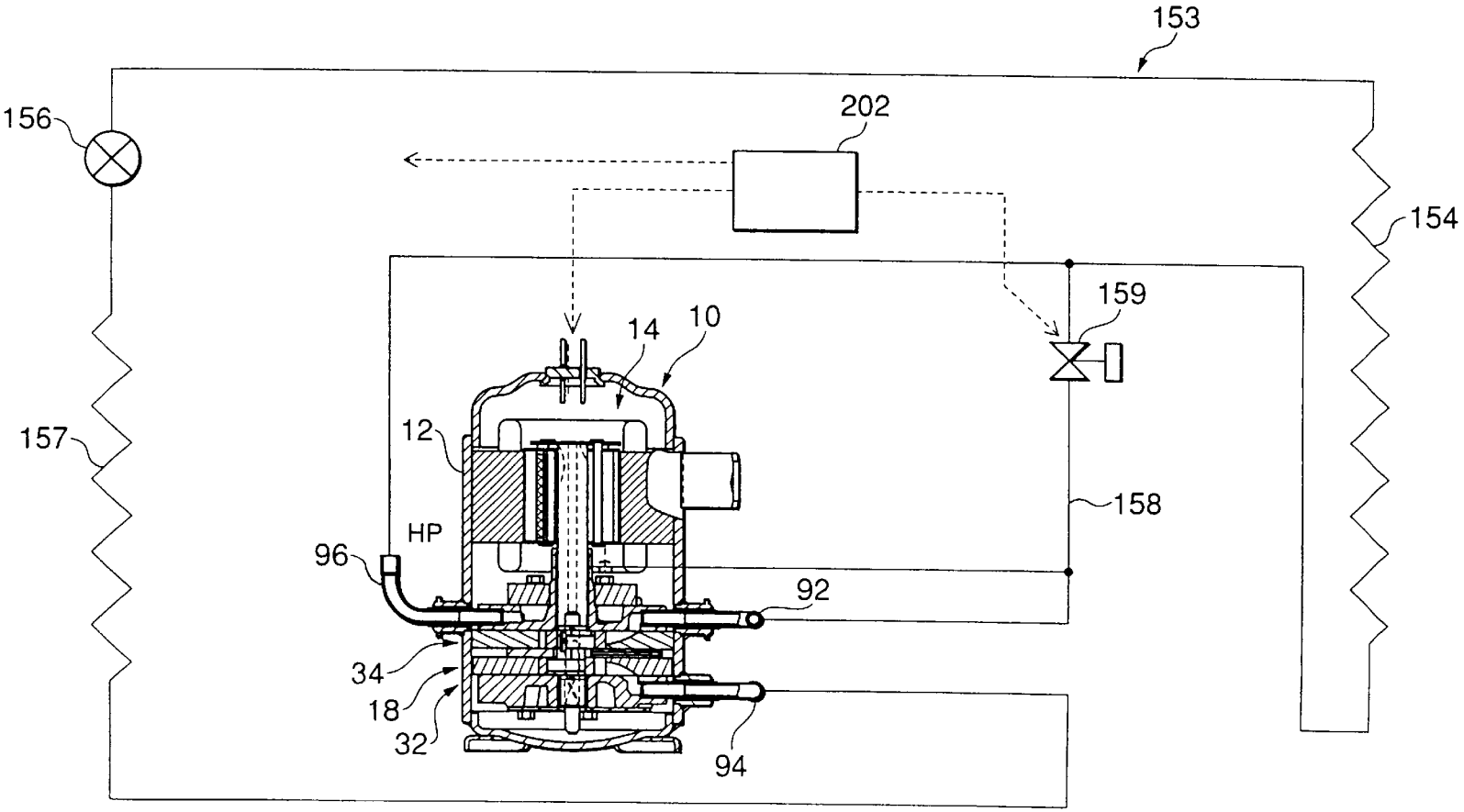
FIG. 18 is a refrigerant circuit diagram of a hot-water supplying apparatus to which the present invention has been applied.

FIG. 18 shows a refrigerant circuit of a hot-water supplying apparatus 153 of the embodiment to which the present invention has been applied. The aforesaid rotary compressor 10 partly constitutes the refrigerant circuit of the hot-water supplying apparatus 153 shown in FIG. 18. More specifically, the refrigerant discharge pipe 96 of the rotary compressor 10 is connected to the inlet of a gas cooler 154 that heats water to produce hot water. The gas cooler 154 is provided on a hot water storage tank (not shown) of the hot-water supplying apparatus 153. The pipe extending out of the gas cooler 154 reaches the inlet of an evaporator 157 via an expansion valve 156 serving as a decompressing device, and the outlet of the evaporator 157 is connected to the refrigerant introducing pipe 94. Branched off midway from the refrigerant introducing pipe 92 is a defrost pipe 158 constituting a defrosting circuit, not shown in FIGS. 2 and 3, and the defrost pipe 158 is connected to the refrigerant discharge pipe 96 extending to the inlet of the gas cooler 154 via a solenoid valve 159 serving as a passage controller. The accumulator 146 is not shown in FIG. 18.

The descriptions will now be given of the operation. Reference numeral 202 denotes a controller constructed of a microcomputer in FIG. 18. The controller 202 controls the number of revolutions of the electromotive unit 14 of the rotary compressor 10, and also controls the solenoid valve 159 and the expansion valve 156. For heating operation, the controller 202 closes the solenoid valve 159. The moment the stator coil 28 of the electromotive unit 14 is energized through the intermediary of the terminal 20 and a wire (not shown) by the controller 202, the electromotive unit 14 is started and the rotor 24 rotates. This causes the upper and lower rollers 46 and 48 fitted to the upper and lower eccentric portions 42 and 44 provided integrally with the rotary shaft 16 to eccentrically rotate in the upper and lower cylinders 38 and 40.

Thus, a low-pressure refrigerant gas (1st-stage suction pressure LP: 4 MPaG) that has been introduced into a low-pressure chamber of the lower cylinder 40 from a suction port 162 via the refrigerant introducing pipe 94 and the suction passage 60 formed in the lower supporting member 56 is compressed by the roller 48 and the vane in operation to obtain an intermediate pressure (MP1: 8 MPaG). The refrigerant gas of the intermediate pressure leaves the high-pressure chamber of the lower cylinder 40, passes through the discharge port 41, the discharge muffling chamber 64 provided in the lower supporting member 56, and the communication passage 63, and is discharged into the hermetic vessel 12 from the intermediate discharge pipe 121.

At this time, the intermediate discharge pipe 121 is directed toward the gap between the adjoining stator coils 28 and 28 wound around the stator 22 of the electromotive unit 14 thereabove; hence, the refrigerant gas still having a relatively low temperature can be positively supplied toward the electromotive unit 14, thus restraining a temperature rise in the electromotive unit 14. At the same time, the pressure inside the hermetic vessel 12 reaches the intermediate pressure (MP1).

The intermediate-pressure refrigerant gas in the hermetic vessel 12 comes out of the sleeve 144 at the above intermediate pressure (MP1), passes through the refrigerant introducing pipe 92 and the suction passage 58 formed in the upper supporting member 54, and is drawn into the low-pressure chamber (2nd-stage suction pressure being MP2) of the upper cylinder 38 through a suction port 161. The intermediate-pressure refrigerant gas that has been drawn in is subjected to a second-stage compression by the roller 46 and the vane 50 in operation so as to be turned into a hot high-pressure refrigerant gas (2nd-stage discharge pressure HP: 12 MPaG). The hot high-pressure refrigerant gas leaves the high-pressure chamber, passes through the discharge port 39, the discharge muffling chamber 62 provided in the upper supporting member 54, and the refrigerant discharge pipe 96, and is introduced into the gas cooler 154. The temperature of the refrigerant at this point has risen to about +100° C. the hot high-pressure refrigerant gas radiates heat from the gas cooler 154 to heat the water in the hot water storing tank to produce hot water of about +90° C.

Meanwhile, the refrigerant itself is cooled in the gas cooler 154 before it leaves the gas cooler 154. The refrigerant is then decompressed by an expansion valve 156, drawn into the evaporator 157 where it evaporates, absorbing heat from its surroundings, and passes through the accumulator 146 (not shown in FIG. 18), and is introduced into the first rotary compressing unit 32 through the refrigerant introducing pipe 94. This cycle is repeated.

Especially in an environment where the open air temperature is low, such a heating operation causes the evaporator 157 to be frosted. In this case, the controller 202 releases a solenoid valve 159 and fully opens the expansion valve 156 to defrost the evaporator 157. This causes the intermediate-pressure refrigerant in the hermetic vessel 12 (including a small volume of the high-pressure refrigerant discharged from the second rotary compressing unit 34) to pass through a defrosting pipe 158 and reach the gas cooler 154. The temperature of the refrigerant ranges from about +50° C. to about +60° C., so that the refrigerant does not radiate heat in the gas cooler 154; instead, the refrigerant absorbs heat. Then, the refrigerant leaves the gas cooler 154, passes through the expansion valve 156, and reaches the evaporator 157. This means that a virtually intermediate-pressure refrigerant having a relatively high temperature is substantially directly supplied to the evaporator 157 without being decompressed, thereby heating the evaporator 157 to defrost it. At this time, the heat of hot water is conveyed from the gas cooler 154 to the evaporator 157 by the refrigerant.

When high-pressure refrigerant discharged from the second rotary compressing unit 34 is supplied to the evaporator 157 without decompressing it so as to defrost the evaporator 157, then the suction pressure of the first rotary compressing unit 32 rises because the expansion valve 156 is fully open, resulting in an increase in the discharge pressure (intermediate pressure) of the first rotary compressing unit 32. The refrigerant is discharged through the intermediate of the second rotary compressing unit 34, and since the expansion valve 156 is fully open, the discharge pressure of the second rotary compressing unit 34 becomes equal to the suction pressure of the first rotary compressing unit 32. As a result, the pressure reversion between the discharge (high pressure) of the second rotary compressing unit 34 and the suction (intermediate pressure) would take place. As described, however, the intermediate-pressure refrigerant gas discharged from the first rotary compressing unit 32 is taken out of the hermetic vessel 12 to defrost the evaporator 157, so that the reversion between the high pressure and the intermediate pressure can be restrained.

Figure 21:
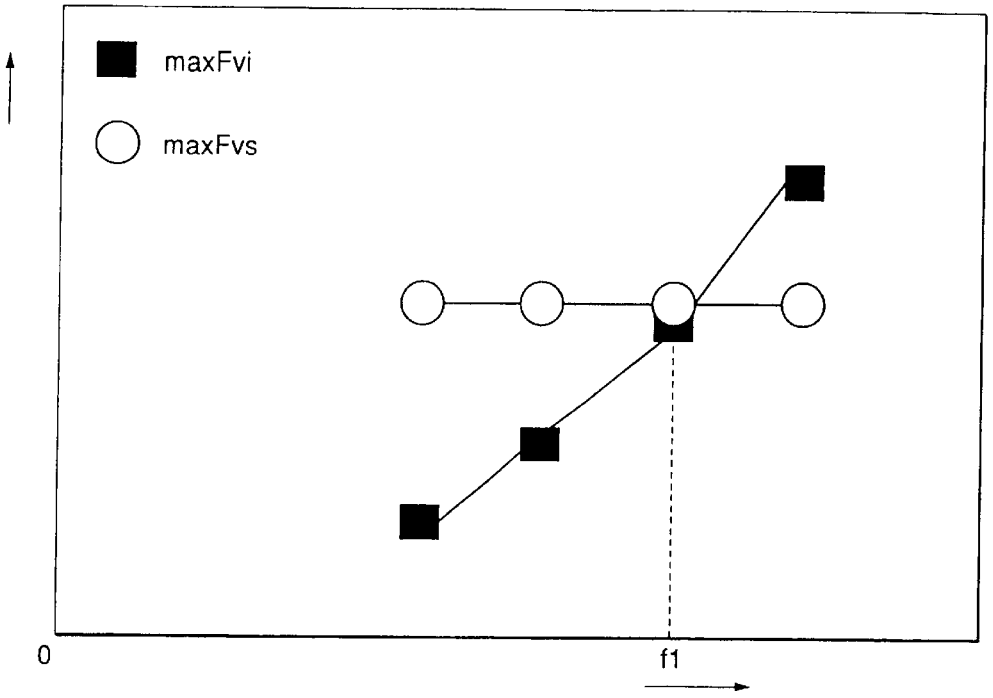
FIG. 21 is a diagram showing the maximum values of the inertial force of a vane and the maximum values of the urging force of a spring at different numbers of revolutions of the electromotive unit of the rotary compressor shown in FIG. 1.

An inertial force Fvi of the vane 50 of the second rotary compressing unit 34 is represented by expression (1) shown below:

$$Fvi[\theta]=-mv\cdot d^2\times[\theta]/dt^2 \quad (1)$$

where mv denotes the mass of the vane 50. Therefore, the inertial force Fvi of the vane 50 is determined by the mass of the vane 50 and the number of revolutions f of the electromotive unit 14, and the maximum value thereof increases as the number of revolutions f increases, as shown in FIG. 21. The maximum value of an urging force (spring force) Fvs of the spring 76 remains substantially constant regardless of the number of revolutions f of the electromotive unit 14, as shown in FIG. 21.

Referring to FIG. 21, if it is assumed that, until the electromotive unit 14 reaches a number of revolutions fl, for example, the inertial force Fvi of the vane 50 is smaller than the urging force Fvs of the spring 76, and this relationship is reversed at f1, then the controller 202 controls the number of revolutions f of the electromotive unit 14 of the rotary compressor 10 at the aforesaid f1 or less while the evaporator 157 is being defrosted.

In this case, while the evaporator 157 is being defrosted, the refrigerant gas discharged from the second rotary compressing unit 34 is introduced into the evaporator 157 without decompressing it by the expansion valve 156 as described above, and the refrigerant gas discharged from the first rotary compressing unit 32 into the hermetic vessel 12 is also introduced into the evaporator 157. This arrangement eliminates the difference between the discharge pressure and the suction pressure of the second rotary compressing unit 34. Hence, the back pressure from the back pressure chamber 201 is no longer applied to the vane 50, and the urging force Fvs of the spring 76 will be the only one force that presses the vane 50 against the roller 46.

Conventionally, if the inertial force Fvi of the vane 50 exceeds the urging force Fvs of the spring 76, the vane 50 leaves the roller 46, which is known as the "vane jump."However, the controller 202 controls the number of revolutions of the electromotive unit 14 at f1 or less while the evaporator 157 is being defrosted, as described above, the inertial force Fvi of the vane 50 will not exceed the urging force Fvs of the spring 76, thus restraining the deterioration of the durability attributable to the vane jump.

In the above embodiment, the controller 202 controls the number of revolutions of the electromotive unit 14 of the rotary compressor 10 to avoid the vane jump problem while the evaporator 157 is being defrosted. Alternatively, however, if the number of revolutions of the electromotive unit 14 for the defrosting mode is set to a predetermined value beforehand (e.g., about 100 Hz for the hot-water supplying apparatus 153), then the material or the configuration of the vane 50 of the rotary compressor 10 may be selected or designed such that the inertial force based on the mass mv does not exceed the urging force of the spring 76 at the number of revolutions (100 Hz) in the defrosting mode. Further alternatively, the spring 76 may have an urging force that surpasses the inertial force of the vane 50 at the above number of revolutions.

Figure 19:
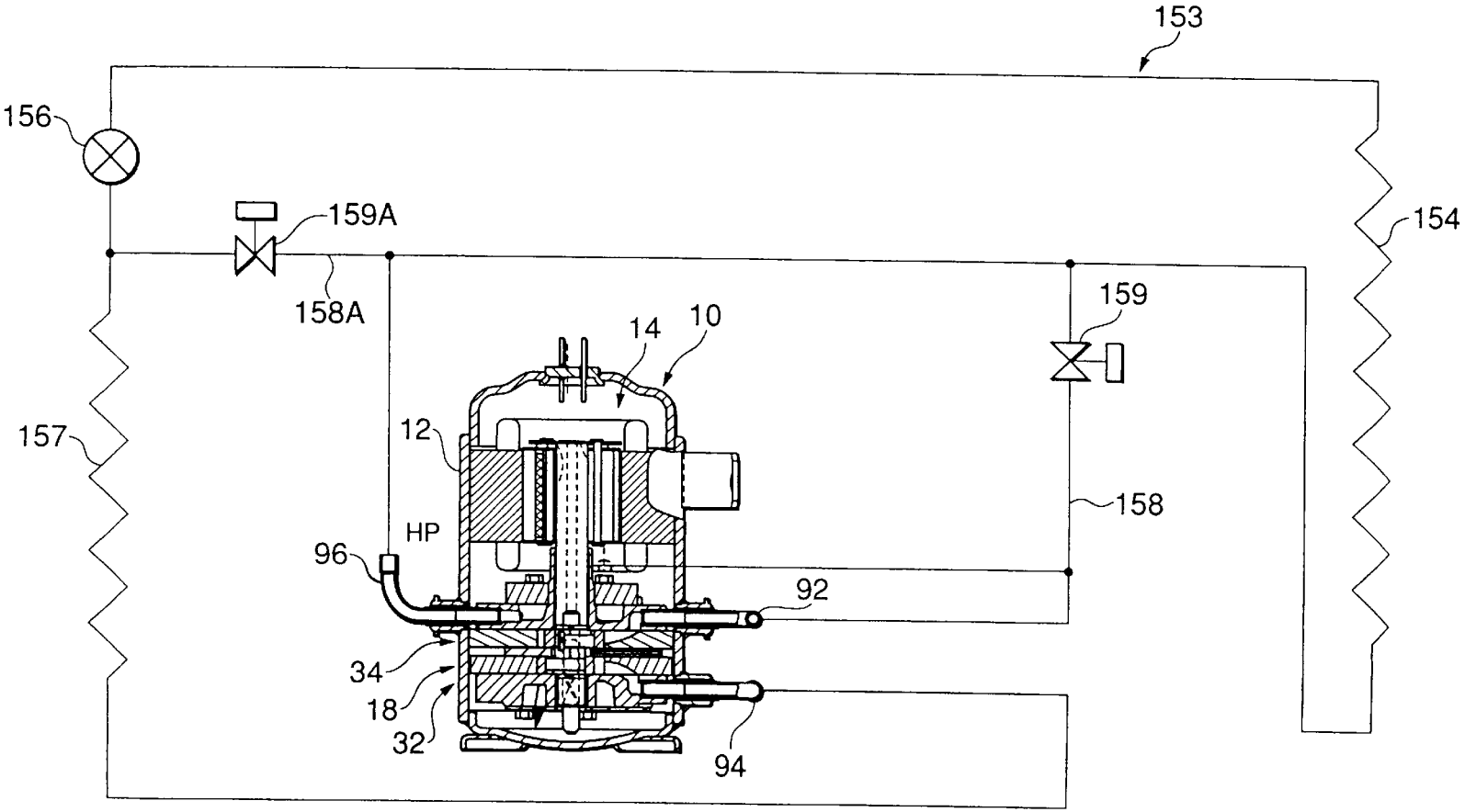
FIG. 19 is a refrigerant circuit diagram of a hot-water supplying apparatus according to another embodiment of the present invention.

FIG. 19 shows another refrigerant circuit of the hot-water supplying apparatus 153 to which the present invention has been applied. The components denoted by the same reference numerals in this figure as those shown in FIG. 18 will have the same or equivalent functions. In this hot-water supplying apparatus 153 is provided with another defrosting pipe 158A for establishing communication with the piping of the refrigerant discharge pipe 96, the expansion valve 156, and the evaporator 157, the defrosting pipe 158A being equipped with a solenoid valve 159A. In this case also, the controller 202, which is not shown in this figure, controls the rotary compressor 10, the expansion valve 156, and the solenoid valves 159 and 159A.

The heating operation in the foregoing arrangement described above will be the same as that described above, because the two solenoid valves 159 and 159A are closed. When defrosting the evaporator 157, both solenoid valves 159 and 159A are released. This causes the intermediate-pressure refrigerant in the hermetic vessel 12 and a small amount of the high-pressure refrigerant discharged from the second rotary compressing unit 34 to flow to the downstream side of the expansion valve 156 through the defrosting pipes 158 and 158A, and directly reaches the evaporator 157 without being decompressed. This arrangement also prevents the pressure reversion in the second rotary compressing unit 34.

Figure 20:
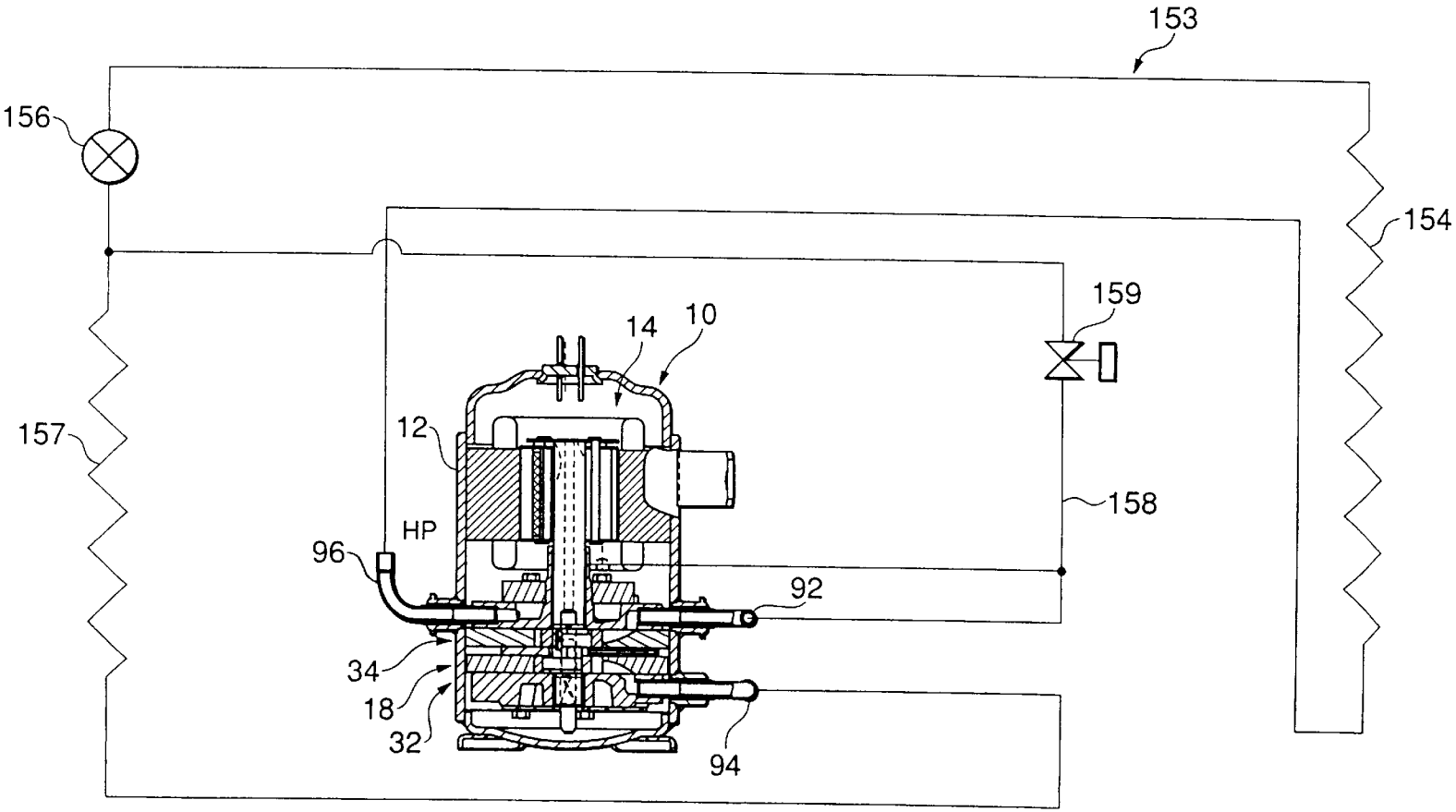
FIG. 20 is a refrigerant circuit diagram of a hot-water supplying apparatus according to yet another embodiment of the present invention.

FIG. 20 shows still another refrigerant circuit of the hot-water supplying apparatus 153. In this refrigerant circuit also, the same reference numerals will denote the components having the same functions as those shown in FIG. 18. In this case also, the rotary compressor 10, the expansion valve 156, and the solenoid valve 159 are controlled by the controller 202, which is not shown in the figure. In this refrigerant circuit, however, the defrosting pipe 158 shown in FIG. 18 is connected to the pipe between the expansion valve 156 and the evaporator 157 rather than the inlet of the gas cooler 154. With this arrangement, when the solenoid valve 159 is released, the intermediate-pressure refrigerant in the hermetic vessel 12 flows to the downstream side of the expansion valve 156 and is directly introduced into the evaporator 157 without being decompressed, as in the refrigerant circuit shown in FIG. 19. This arrangement is advantageous in that the pressure reversion of the second rotary compressing unit 34 that usually takes place in the defrosting mode can be restrained, and the number of solenoid valves can be reduced, as compared with the refrigerant circuit shown in FIG. 19.

In the embodiments discussed above, the outside diameter of the plug 137 is set to be larger than the inside diameter of the housing portion 70A to the extent that will not cause the upper cylinder 38 to deform, and the plug 137 is press-fitted into the housing portion 70A. As an alternative, however, the outside diameter of the plug 137 may be set to be smaller than the inside diameter of the housing portion 70A and the plug 137 may be gap-fitted into the housing portion 70A.

The aforesaid dimensional relationship makes it possible to securely prevent the inconvenience in which the upper cylinder 38 deforms with consequent degraded sealing with respect to the upper supporting member 54, leading to deteriorated performance. Such gap fitting should not cause any functional problems with the plug 138, because the interval between the upper cylinder 38 and the hermetic vessel 12 is set to be smaller than the distance from the O-ring 138 to the end of the plug 137 that is adjacent to the hermetic vessel 12, as discussed above. Hence, even when the plug 137 moves in the direction in which it is pushed out of the housing portion 70A by the high pressure (the back pressure of the vane 50) at the spring 76 side, the O-ring 138 still remains in the housing portion 70A to maintain the sealing at the point where the plug 137 abuts against the hermetic vessel 12 and can no longer move.

When the rotary compressor 10 stops, the pressure in the upper cylinder 38 is influenced by the low pressure side through the intermediary of the refrigerant circuit, and lowers down below the intermediate pressure in the hermetic vessel 12. In such a case, the plug 137 tends to be pushed in toward the spring 76 due to the pressure in the hermetic vessel 12, the plug 137 abuts against the stopper 210 and cannot move any further toward the spring 76, thus preventing the problem in that the spring 76 is crushed by the plug 137 that travels.

In the embodiments, the rotary compressor 10 has been used with the refrigerant circuit of the hot-water supplying apparatus 153; the present invention, however, is not limited thereto. The rotary compressor 10 may alternatively be used for an indoor heater or the like.

As described in detail above, according to the present invention, when defrosting the evaporator, the refrigerant gas discharged from the second rotary compressing unit of the rotary compressor and the refrigerant gas discharged from the first rotary compressing unit are introduced into the evaporator without decompressing them. This prevents the inconvenient reversion of the discharge pressure and the suction pressure of the second rotary compressing unit of the rotary compressor when defrosting the evaporator.

Especially because the inertial force of the vane at the number of revolutions of the electromotive unit when the evaporator is defrosted is smaller than the urging force of the spring, so that the inconvenient vane jump in the second rotary compressing unit can be restrained when defrosting the evaporator. Thus, the evaporator can be defrosted without sacrificing the durability of the rotary compressor.

Moreover, according to the present invention, in a rotary compressor that has a hermetic vessel housing an electromotive unit and first and second rotary compressing units driven by the electromotive unit, discharges a gas that has been compressed by the first rotary compressing unit into the hermetic vessel, and further compresses the discharged, intermediate-pressure gas by the second rotary compressing unit, the rotary compressor including a cylinder constituting the second rotary compressing unit and a roller that is fitted to an eccentric portion formed in a rotary shaft of the electromotive unit and eccentrically rotates in the cylinder, a vane abutted against the roller to partition the interior of the cylinder into a low-pressure chamber and a high-pressure chamber, a spring for constantly urging the vane toward the roller, an housing portion for the spring that is open toward the vane and toward the hermetic vessel, and a plug that is provided in the housing portion and positioned adjacently to the hermetic vessel of the spring, and a plug for sealing the housing portion. The inner wall of the housing portion that is positioned at the spring side of the plug is provided with the stopper against which the plug abuts at a predetermined position, thereby preventing the plug from moving any further toward the spring.

With this arrangement, the plug can be accurately positioned. Accordingly, by setting the outside diameter of the plug to be larger than the inside diameter of the housing portion within the range that will not cause the cylinder to deform when the plug is inserted into the housing portion, the plug can be positioned when press-fitting it without causing the deformation of the cylinder by the insertion of the plug. This leads to easier installation of the plug.

If, for example, the outside diameter of the plug is set to be smaller than the inside diameter of the housing portion, then the inconvenience can be avoided in which the plug is pushed in toward the spring due to the intermediate pressure in the hermetic vessel when the rotary compressor stops.

The stopper is formed by reducing the diameter of the inner peripheral wall of the housing portion so as to form a stepped portion on the inner peripheral wall. This makes it possible to easily form the stopper in the housing portion of the cylinder, leading to reduced production cost.

Especially when a $CO_2$ gas is used as a refrigerant and the pressure difference is large, the present invention will provide marked advantages for improving the performance of the rotary compressor.

When a gas cooler is used to generate hot water, the heat of the hot water of the gas cooler can be conveyed to an evaporator by means of a refrigerant, permitting the evaporator to be defrosted more quickly.

What is claimed is:

1. In a refrigerant circuit comprising:

a rotary compressor that has a hermetic vessel housing an electromotive unit and first and second rotary compressing units driven by the electromotive unit, discharges a refrigerant gas that has been compressed by the first rotary compressing unit into the hermetic vessel, and further compresses the discharged, intermediate-pressure refrigerant gas by the second rotary compressing unit;

a gas cooler into which the refrigerant discharged from the second rotary compressing unit of the rotary compressor flows;

a decompressor connected to the outlet end of the gas cooler; and an evaporator connected to the outlet end of the decompressor, the refrigerant from the evaporator being compressed by the first rotary compressing unit, the rotary compressor comprising:

a cylinder constituting the second rotary compressing unit and a roller that is fitted to an eccentric portion formed in a rotary shaft of the electromotive unit and eccentrically rotates in the cylinder;

a vane abutted against the roller to partition the interior of the cylinder into a low-pressure chamber and a high-pressure chamber;

a spring for constantly urging the vane toward the roller; and a back pressure chamber for applying the discharge pressure of the second rotary compressing unit to the vane as a back pressure, a defroster of the refrigerant circuit that, in order to defrost the evaporator, introduces the refrigerant gas discharged from the second rotary compressing unit into the evaporator without being decompressed by the decompressor, also introduces the refrigerant gas discharged from the first rotary compressing unit into the evaporator, drives the electromotive unit of the rotary compressor at a predetermined number of revolutions, and sets the inertial force of the vane at the predetermined number of revolutions to be smaller than the urging force of the spring.

2. In a refrigerant circuit, comprising:

a rotary compressor that has a hermetic vessel housing an electromotive unit and first and second rotary compressing units driven by the electromotive unit, discharges a refrigerant gas that has been compressed by the first rotary compressing unit into the hermetic vessel, and further compresses the discharged, intermediate-pressure refrigerant gas by the second rotary compressing unit;

a gas cooler into which the refrigerant discharged from the second rotary compressing unit of the rotary compressor flows;

a decompressor connected to the outlet end of the gas cooler; and an evaporator connected to the outlet end of the decompressor, the refrigerant from the evaporator being compressed by the first rotary compressing unit, the rotary compressor comprising:

a cylinder constituting the second rotary compressing unit;

a roller that is fitted to an eccentric portion formed in a rotary shaft of the electromotive unit and eccentrically rotates in the cylinder;

a vane abutted against the roller to partition the interior of the cylinder into a low-pressure chamber and a high-pressure chamber;

a spring for constantly urging the vane toward the roller; and a back pressure chamber for applying the discharge pressure of the second rotary compressing unit to the vane as a back pressure, a defroster of the refrigerant circuit that, in order to defrost the evaporator, introduces the refrigerant gas discharged from the second rotary compressing unit into the evaporator without being decompressed by the decompressor, also introduces the refrigerant gas discharged from the first rotary compressing unit into the evaporator, and drives the electromotive unit of the rotary compressor at a number of revolutions at which the inertial force of the vane is smaller than the urging force of the spring.

3. A rotary compressor used in a refrigerant circuit comprising the refrigerant circuit comprises a hermetic vessel housing an electromotive unit and first and second rotary compressing units driven by the electromotive unit, wherein a refrigerant gas that has been compressed by the first rotary compressing unit is discharged into the hermetic vessel, and the discharged, intermediate-pressure refrigerant gas is further compressed by the second rotary compressing unit, and a gas cooler into which the refrigerant discharged from the second rotary compressing unit of the rotary compressor flows, a decompressor connected to the outlet end of the gas cooler, and an evaporator connected to the outlet end of the decompressor are included, the electromotive unit is driven at a predetermined number of revolutions, and the refrigerant gases discharged from the first and second rotary compressing units are introduced into the evaporator without decompressing the refrigerant gas when defrosting the evaporator, the rotary compressor comprising:

a cylinder for constituting the second rotary compressing unit;

a roller that is fitted to an eccentric portion formed in a rotary shaft of the electromotive unit and eccentrically rotates in the cylinder;

a vane abutted against the roller to partition the interior of the cylinder into a low-pressure chamber and a high-pressure chamber;

a spring for constantly urging the vane toward the roller; and a back pressure chamber for applying the discharge pressure of the second rotary compressing unit to the vane as a back pressure, wherein the inertial force of the vane at the number of revolutions of the electromotive unit when defrosting the evaporator is lower than the urging force of the spring.

4. A rotary compressor comprising:

a hermetic vessel housing an electromotive unit and first and second rotary compressing units driven by the electromotive unit, a refrigerant gas that has been compressed by the first rotary compressing unit being discharged into the hermetic vessel, and the discharged, intermediate-pressure refrigerant gas being further compressed by the second rotary compressing unit;

a cylinder for constituting the second rotary compressing unit;

a roller that is fitted to an eccentric portion formed in a rotary shaft of the electromotive unit and eccentrically rotates in the cylinder;

a vane abutted against the roller to partition the interior of the cylinder into a low-pressure chamber and a high-pressure chamber;

a spring for constantly urging the vane toward the roller;

a housing for the spring that is provided in the cylinder and opens to the vane and to the hermetic vessel; and a plug for sealing the housing, the plug being provided in the housing so that it is positioned at the hermetic vessel side of the spring, wherein the inner wall of the housing positioned adjacently to the spring of the plug is provided with a stopping portion against which the plug abuts at a predetermined position.

5. A rotary compressor according to claim 4, wherein the outside diameter of the plug is set to be larger than the inside diameter of the housing to an extent that does not cause the cylinder to deform when the plug is inserted into the housing.

6. A rotary compressor according to claim 4, wherein the outside diameter of the plug is set to be smaller than the inside diameter of the housing.

7. A rotary compressor according to any one of claims 4, 5, and 6, wherein the stopping portion is formed by reducing the diameter of the inner peripheral wall of the housing to form a stepped portion.

8. A defroster for a refrigerant circuit or a rotary compressor according to any one of claims 1 to 6, wherein each of the rotary compressing units uses $CO_2$ gas as a refrigerant to effect compression.

9. A defroster for a refrigerant circuit or a rotary compressor according to any one of claims 1 to 6, wherein hot water is produced by the heat dissipated from the gas cooler.

10. A defroster for a refrigerant circuit or a rotary compressor according to claim 7, wherein each of the rotary compressing units uses $CO_2$ gas as a refrigerant to effect compression.

11. A defroster for a refrigerant circuit or a rotary compressor according to claim 7, wherein hot water is produced by the heat dissipated from the gas cooler.

12. A defroster for a refrigerant circuit or a rotary compressor according to claim 8, wherein hot water is produced by the heat dissipated from the gas cooler.

* * * * *